US012209583B2

(12) United States Patent
Namiki et al.

(10) Patent No.: US 12,209,583 B2
(45) Date of Patent: Jan. 28, 2025

(54) SCROLL COMPRESSOR

(71) Applicant: KABUSHIKI KAISHA TOYOTA JIDOSHOKKI, Kariya (JP)

(72) Inventors: Ken Namiki, Kariya (JP); Takuro Yamashita, Kariya (JP); Shiori Yamamoto, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/213,945

(22) Filed: Jun. 26, 2023

(65) Prior Publication Data

US 2023/0417245 A1 Dec. 28, 2023

(30) Foreign Application Priority Data

Jun. 28, 2022 (JP) ..... 2022-103204

(51) Int. Cl.

| | |
|---|---|
| ***F04C 18/02*** | (2006.01) |
| ***F01C 17/06*** | (2006.01) |
| ***F04C 23/00*** | (2006.01) |
| ***F04C 29/00*** | (2006.01) |

(52) U.S. Cl.

CPC ..... *F04C 18/0215* (2013.01); *F04C 18/0246* (2013.01); *F04C 29/0085* (2013.01); *F04C 23/008* (2013.01); *F04C 2270/13* (2013.01)

(58) Field of Classification Search

CPC .. F04C 18/02; F04C 18/0215; F04C 18/0246; F04C 29/0085; F04C 29/002; F04C 29/00; F04C 23/008; F01C 17/063

See application file for complete search history.

(56) References Cited

FOREIGN PATENT DOCUMENTS

| | | | | |
|---|---|---|---|---|
| KR | 20160005497 A | * | 7/2014 | ..... F04C 18/0215 |
| KR | 20170042131 A | * | 4/2017 | ..... F04C 18/0215 |
| WO | WO-2018003032 A1 | * | 1/2018 | ..... F04C 18/02 |

* cited by examiner

*Primary Examiner* — Deming Wan

(74) *Attorney, Agent, or Firm* — Sughrue Mion, PLLC

(57) ABSTRACT

A scroll compressor includes a housing, a first scroll, a second scroll being configured to rotate relative to the first scroll about a driving axis of the scroll compressor. The second scroll has an end plate, a spiral element, and an adjustment portion adjusting a center-of-gravity of the second scroll. The adjustment portion has a bottom surface, a peripheral surface enclosing the bottom surface, and a connection surface connecting the bottom surface to the peripheral surface. The peripheral surface has a first peripheral surface and a second peripheral surface. A length of the first peripheral surface in a direction in which the driving axis extends is shorter than a length of the second peripheral surface in the direction in which the driving axis extends.

8 Claims, 13 Drawing Sheets

SCROLL COMPRESSOR

CROSS-REFERENCE TO RELATED APPLICATION

This application claims priority to Japanese Patent Application No. 2022-103204 filed on Jun. 28, 2022, the entire disclosure of which is incorporated herein by reference.

BACKGROUND ART

The present disclosure relates to a scroll compressor.

There is known a scroll compressor disclosed in International Patent Application Publication No. 2018/003032. The scroll compressor includes a housing, a first scroll, and a second scroll. The first scroll is fixed in the housing. The second scroll is disposed in the housing. The second scroll is rotated relative to the first scroll about a driving axis of the scroll compressor to form a compression chamber in which fluid is compressed, between the second scroll and the first scroll.

The second scroll includes an end plate, a spiral element, and a plurality of adjustment portions. The end plate is formed in a disc shape and extends orthogonally to the driving axis. The end plate has a first surface facing the first scroll and a second surface opposite to the first surface. The spiral element is integrally formed with the end plate, and spirally protrudes from the first surface toward the first scroll in a direction in which the driving axis extends. The adjustment portions are formed in the end plate, and recessed from the second surface toward the first surface. That is, the adjustment portions are located opposite to the spiral element in the end plate. The plurality of adjustment portions is formed in the end plate.

In such a scroll compressor, the adjustment portions adjust a center-of-gravity of the second scroll to cause the center-of-gravity of the second scroll to approach the driving axis as closely as possible. As a result, in the scroll compressor, the second scroll is suitably rotated about the driving axis, thereby preventing noise generated during an operation of the scroll compressor.

This type of scroll compressor is required to increase a capacity for compressing fluid. To meet the above needs, it is considered that in the above-described known scroll compressor, the compression chamber, which is formed between the second scroll and the first scroll, is increased in size by increasing a length of the spiral element in the direction in which the driving axis extends (hereinafter simply called the driving axis direction).

However, the increasing of the length of the spiral element in the driving axis direction shifts the center-of-gravity of the second scroll from the driving axis, which causes the second scroll not to be suitably rotated about the driving axis. As a result, noise generated during an operation of the scroll compressor is increased. For that reason, it is necessary that according to the increasing of the length of the spiral element in the driving axis direction, the adjustment portions are formed so as to be further deeply recessed into the end plate to adjust the center-of gravity of the second scroll. The second scroll, which also includes the adjustment portions, is generally formed by casting. As the adjustment portions are formed so as to be recessed further deeply, fluidity of molten metal to form the adjustment portions is reduced, which makes it difficult to produce the adjustment portions and therefore the second scroll. This reduces an efficiency of producing the scroll compressor, and causes an increase in production cost.

The present disclosure has been made in view of the above-described known circumstances and is directed to providing a scroll compressor that is superior in quietness while a capacity for compressing fluid is increased, the scroll compressor being produced at low cost.

SUMMARY

In accordance with an aspect of the present disclosure, there is provided a scroll compressor that includes a housing, a first scroll disposed in the housing, and a second scroll disposed in the housing and facing the first scroll to form a compression chamber between the first scroll and the second scroll The second scroll is configured to rotate relative to the first scroll about a driving axis of the scroll compressor to compress fluid in the compression chamber. The second scroll has an end plate formed in a disc shape extending orthogonally to the driving axis, the end plate having a first surface facing the first scroll and a second surface located opposite to the first surface, a spiral element integrally formed with the end plate and spirally protruding from the first surface toward the first scroll in a direction in which the driving axis extends, and an adjustment portion formed in the end plate and recessed from the second surface toward the first surface, the adjustment portion adjusting a center-of-gravity of the second scroll. The adjustment portion has a bottom surface extending in parallel with the second surface, a peripheral surface enclosing the bottom surface and extending in the direction in which the driving axis extends, and a connection surface located between the bottom surface and the peripheral surface, and connecting the bottom surface to the peripheral surface. The peripheral surface has a first peripheral surface located close to an outer periphery of the end plate and a second peripheral surface located closer to the driving axis than the first peripheral surface and facing the first peripheral surface in a radial direction of the end plate. A length of the first peripheral surface in the direction in which the driving axis extends is shorter than a length of the second peripheral surface in the direction in which the driving axis extends.

In accordance with another aspect of the present disclosure, there is provided a scroll compressor that includes a housing, a first scroll disposed in the housing, and a second scroll disposed in the housing and facing the first scroll to form a compression chamber between the first scroll and the second scroll. The second scroll is configured to rotate relative to the first scroll about a driving axis of the scroll compressor to compress fluid in the compression chamber. The second scroll has an end plate formed in a disc shape extending orthogonally to the driving axis, the end plate having a first surface facing the first scroll and a second surface located opposite to the first surface, a spiral element integrally formed with the end plate and spirally protruding from the first surface toward the first scroll in a direction in which the driving axis extends, and an adjustment portion formed in the end plate and recessed from the second surface toward the first surface, the adjustment portion adjusting a center-of-gravity of the second scroll. The adjustment portion has a bottom surface extending in parallel with the second surface, a peripheral surface enclosing the bottom surface and extending in the direction in which the driving axis extends, and a connection surface located between the bottom surface and the peripheral surface, and connecting the bottom surface to the peripheral surface. The peripheral surface has a first peripheral surface located close to an outer periphery of the end plate and a second peripheral surface located closer to the driving axis than the first peripheral surface and facing the first peripheral surface in a radial direction of the end plate. A length of the second peripheral surface in the direction in which the driving axis extends is shorter than a length of the first peripheral surface in the direction in which the driving axis extends.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe a first embodiment to fourth embodiment according to the present disclosure with reference to the drawings. A scroll compressor (hereinafter, simply called the compressor) in each of the first embodiment to the fourth embodiment is mounted on a vehicle (not illustrated), and is one of parts constituting a refrigeration circuit of the vehicle.

First Embodiment

Figure 1:
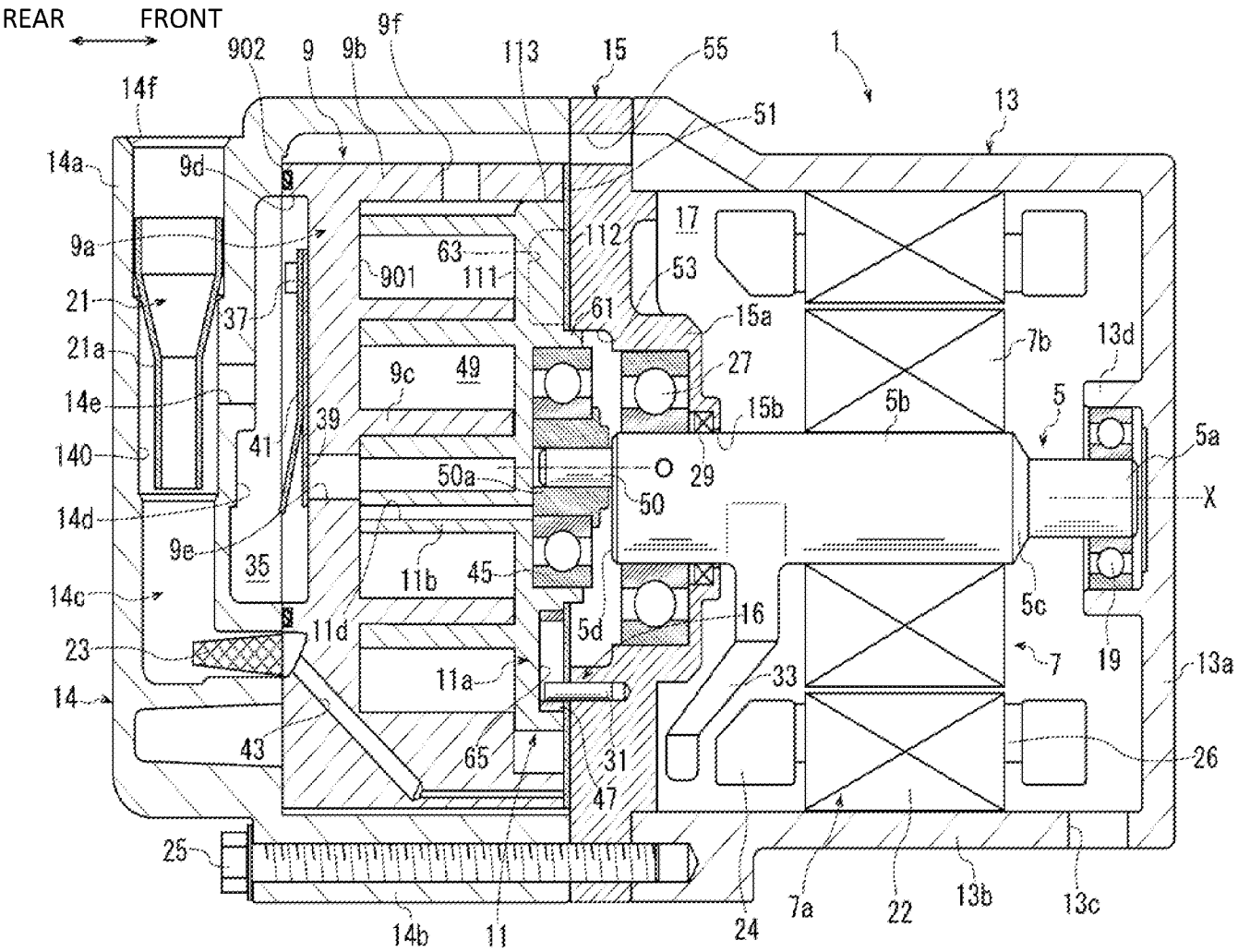
FIG. 1 is a cross-sectional view illustrating a scroll compressor according to a first embodiment.

As illustrated in FIG. 1, the compressor of the first embodiment includes a housing 1, a driving shaft 5, an electric motor 7, a fixed scroll 9, and a movable scroll 11. The fixed scroll 9 corresponds to the "first scroll" in the present disclosure. The movable scroll 11 corresponds to the "second scroll" in the present disclosure.

Figure 3:
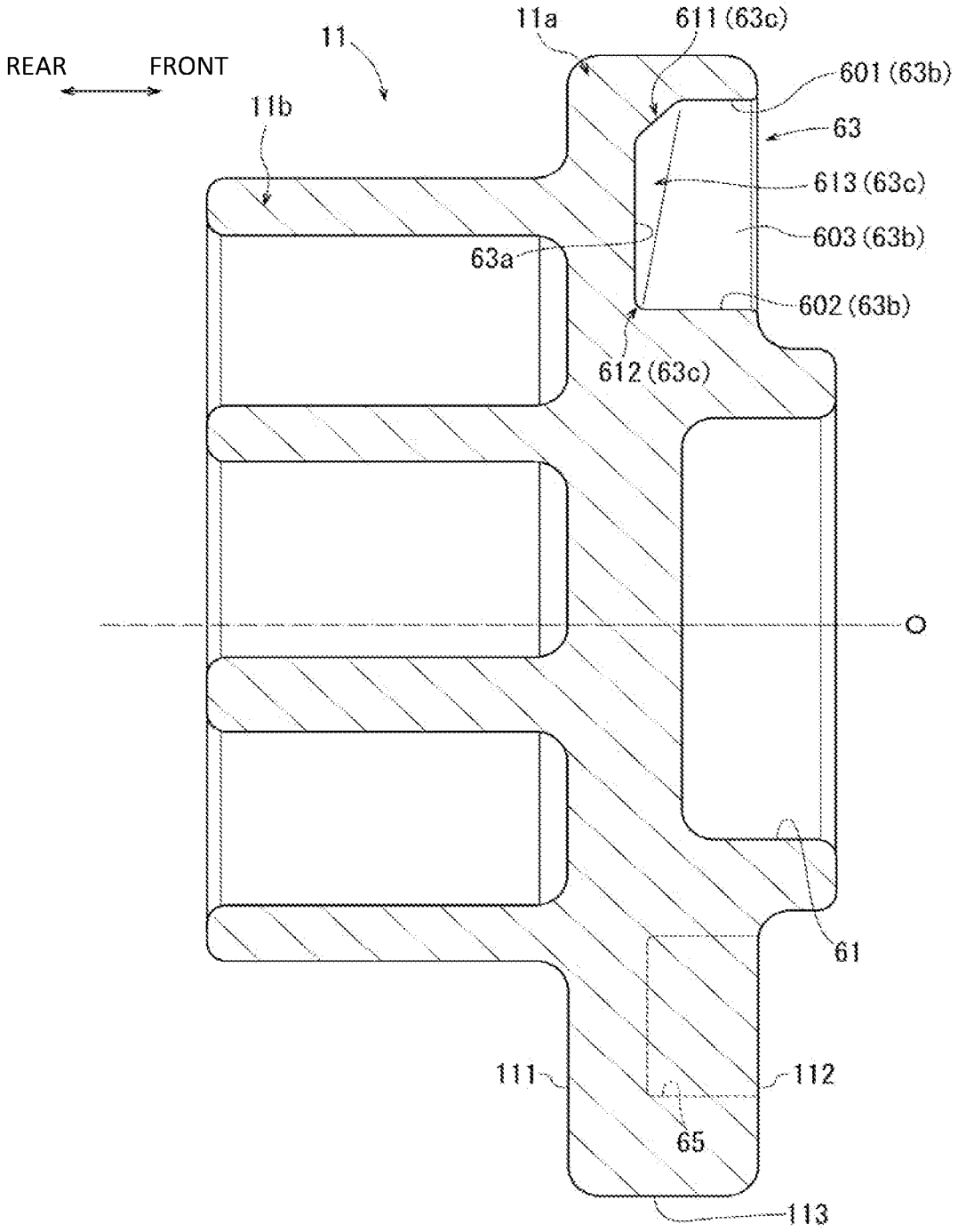
FIG. 3 is a cross-sectional view taken along a line A-A of FIG. 2 according to the scroll compressor of the first embodiment.

In the present embodiments, an arrow in FIG. 1, which is drawn by a solid line, indicates a front direction and a rear direction of the compressor. In FIG. 3 and the subsequent figures, the front direction and the rear direction of the compressor are shown in correspondence with FIG. 1. The front direction and the rear direction are one example used for convenience of explanation, and a posture of the compressor is changed as appropriate in correspondence with a vehicle on which the compressor is mounted, or the like.

As illustrated in FIG. 1, the housing 1 is formed of a motor housing 13, a compressor housing 14, and a fixed block 15. The motor housing 13 serves as a front portion of the housing 1, and the compressor housing 14 serves as a rear portion of the housing 1.

The motor housing 13 has a front wall 13*a* and a first peripheral wall 13*b*. The front wall 13*a* is located at a front end of the motor housing 13, and extends in a radial direction of the motor housing 13. The first peripheral wall 13*b* is connected to the front wall 13*a*, and extends in the rear direction from the front wall 13*a*. The front wall 13*a* and the first peripheral wall 13*b* constitute the motor housing 13 formed in a bottomed tubular shape, which opens in the rear direction. A suction chamber 17 is formed in the motor housing 13.

The motor housing 13 also has a suction opening 13*c* and a supporting portion 13*d*. The suction opening 13*c* is formed in the first peripheral wall 13*b*, and communicates with the suction chamber 17. The suction opening 13*c* is connected to an evaporator (not illustrated) through a pipe (not illustrated), and refrigerant gas flowing from the evaporator is sucked into the suction chamber 17 through the suction opening 13*c*. The refrigerant gas corresponds to the "fluid" in the present disclosure.

The supporting portion 13*d* protrudes from the front wall 13*a* into the suction chamber 17. The supporting portion 13*d* is formed in a cylindrical shape, and has therein a first radial bearing 19. The suction opening 13*c* may be formed in the front wall 13*a*.

The compressor housing 14 has a rear wall 14*a* and a second peripheral wall 14*b*. The rear wall 14*a* is located in a rear end of the compressor housing 14, and extends in a radial direction of the compressor housing 14. The second peripheral wall 14*b* is connected to the rear wall 14*a*, and extends in the front direction from the rear wall 14*a*. The rear wall 14*a* and the second peripheral wall 14*b* constitute the compressor housing 14 formed in a bottomed tubular shape, which opens in the front direction.

The compressor housing 14 has an oil separation chamber 14*c*, a first discharge recess 14*d*, a discharge passage 14*e*, and a discharge opening 14*f*. The oil separation chamber 14*c* is located in a rear portion of the compressor housing 14, and extends in the radial direction of the compressor housing 14. The first discharge recess 14*d* is located in front of the oil separation chamber 14*c* in the compressor housing 14, and recessed toward the oil separation chamber 14*c*. The discharge passage 14*e* extends in a longitudinal direction of the compressor, and provides communication between the oil separation chamber 14*c* and the first discharge recess 14*d*. The discharge opening 14*f* communicates with an upper end of the oil separation chamber 14*c*, and opens to the outside of the compressor housing 14. The discharge opening 14*f* is connected to a condenser (not illustrated) through a pipe.

A separation cylinder 21 is fixed in the oil separation chamber 14*c*. The separation cylinder 21 has an outer peripheral surface 21*a* formed in a cylindrical shape. An axis of the outer peripheral surface 21*a* coincides with an axis of an inner peripheral surface 140 of the oil separation chamber 14*c*. The outer peripheral surface 21*a* and the inner peripheral surface 140 constitute a separator. In the oil separation chamber 14*c*, a filter 23 is disposed below the separation cylinder 21.

The fixed block 15 is formed between the motor housing 13 and the compressor housing 14. The motor housing 13, the fixed block 15, and the compressor housing 14 are fastened by a plurality of bolts 25, which is inserted from the compressor housing 14 to the motor housing 13. While the fixed block 15 is held between the motor housing 13 and the compressor housing 14, the fixed block 15 is fixed to the motor housing 13 and the compressor housing 14. Thus, the fixed block 15 is located between the suction chamber 17 and the movable scroll 11 in the longitudinal direction of the compressor. FIG. 1 illustrates only one bolt 25 of the plurality of bolts 25. A method of fixing the motor housing 13, the compressor housing 14, and the fixed block 15 may be designed as appropriate.

A boss 15*a* protruding in the front direction is formed in the fixed block 15. The boss 15*a* has, in an end thereof, an insertion hole 15*b*. A second radial bearing 27 and a sealing member 29 are disposed in the boss 15*a*. A suction passage 55 is formed in the fixed block 15. The suction passage 55 is located on a radially outward side of the boss 15*a* in the fixed block 15, and extends through the fixed block 15 in the longitudinal direction of the compressor. The number of the suction passage 55 may be designed as appropriate.

A plurality of anti-rotation pins 31 is fixed in the fixed block 15. The anti-rotation pins 31 extend in the rear direction from the fixed block 15. FIG. 1 illustrates one of the plurality of anti-rotation pins 31.

The driving shaft 5 is disposed in the housing 1. The driving shaft 5 has a columnar shape extending in the longitudinal direction of the compressor. The driving shaft 5 is formed of a small diameter portion 5*a*, a large diameter portion 5*b*, and a taper portion 5*c*. The small diameter portion 5*a* is located close to a front end of the driving shaft 5. The large diameter portion 5*b* is located in a rear of the small diameter portion 5*a*, and has a larger diameter than that of the small diameter portion 5*a*. The large diameter portion 5*b* has, in a rear end thereof, a rear end surface 5*d* formed in a flat shape. The taper portion 5*c* is located between the small diameter portion 5*a* and the large diameter portion 5*b*. A front end of the taper portion 5*c* is connected to the small diameter portion 5*a*. A diameter of the taper portion 5*c* increases as the taper portion 5*c* extends in the rear direction, and a rear end of the taper portion 5*c* is connected to the large diameter portion 5*b*.

The driving shaft 5, in particular, the small diameter portion 5*a* of the driving shaft 5, is rotatably supported by the supporting portion 13*d* of the motor housing 13 through the first radial bearing 19. A rear end portion of the large diameter portion 5*b* is inserted into the insertion hole 15*b* of the fixed block 15, and enters the boss 15*a*. In the boss 15*a*, the rear end portion of the large diameter portion 5*b* is rotatably supported by the second radial bearing 27. Thus, the rotary shaft 5 is rotatable about a rotating axis X in the housing 1. The rotating axis X extends in parallel with the longitudinal direction of the compressor. The sealing member 29 is interposed between the fixed block 15 and the driving shaft to form a seal.

In the driving shaft 5, an eccentric pin 50 is fixed to the large diameter portion 5*b*. The eccentric pin 50 is disposed at a position of the rear end surface 5*d*, which is shifted from the rotating axis X. The eccentric pin 50 is formed in a columnar shape having a smaller diameter than that of the driving shaft 5, and extends in the rear direction from the rear end surface 5*d*. An axis of the eccentric pin 50 is referred to as a driving axis O. As described above, the eccentric pin 50 is disposed at the position, which is shifted from the rotating axis X, and thus, the driving axis O is also disposed at the position, which is shifted from the rotating axis X. The driving axis O extends in the longitudinal direction of the compressor in parallel with the rotating axis X. The rear end portion of the large diameter portion 5*b* is inserted into the insertion hole 15*b*, and the eccentric pin 50 enter the boss 15*a*. The eccentric pin 50 is fitted to a bushing 50*a* in the boss 15*a*.

Furthermore, in the driving shaft 5, a balance weight 33 is integrally formed with the large diameter portion 5*b*. The balance weight 33 is disposed at a position distant from the rotating axis X in the large diameter portion 5*b*. More specifically, the balance weight 33 is disposed at the position distant from the eccentric pin 50 across the rotating axis X.

Although not illustrated in detail, the balance weight 33 is formed in a substantially fan-like plate shape. The balance weight 33 extends in a direction away from the large diameter portion 5*b* in a radial direction of the driving shaft 5. The radial direction of the driving shaft 5 is a direction orthogonal to the longitudinal direction of the compressor. That is, the balance weight 33 extends from the large diameter portion 5*b* toward the first peripheral wall 13*b* of the motor housing 13. The driving shaft 5 is disposed in the housing 1, and the balance weight 33 is located in the suction chamber 17. More specifically, the balance weight 33 is located between the fixed block 15 and the electric motor 7 in the suction chamber 17. The balance weight 33 may be designed in any shape as appropriate.

The electric motor 7 is accommodated in the suction chamber 17. That is, the suction chamber 17 also serves as a motor chamber, which accommodates the electric motor 7. The electric motor 7 is located in front of the balance weight 33 in the suction chamber 17.

The electric motor 7 includes a stator 7*a* and a rotor 7*b*. The stator 7*a* is fixed on an inner peripheral surface of the first peripheral wall 13*b*. The stator 7*a* is connected to an inverter (not illustrated) provided outside the motor housing 13.

The stator 7*a* has a stator core 22 and coil ends 24. The stator core 22 is formed in a cylindrical shape. A coil 26 is wound around the stator core 22. The coil ends 24 are each formed in a ring shape protruding from the stator core 22 to the front and the rear of the stator core 22 in an axial direction of the stator core 22. Each of the coil ends 24 is a part of the coil 26. An inner portion of a rear end portion of the coil end 24 is inclined so as to avoid interference with the balance weight 33.

The rotor 7*b* is disposed in the stator 7*a*. The large diameter portion 5*b* of the driving shaft 5 is press-fitted into the rotor 7*b*. Thus, the driving shaft 5 is fixed to the rotor 7*b*. The rotor 7*b* rotates in the stator 7*a*, thereby rotating the driving shaft 5 about the rotating axis X.

The fixed scroll 9 is fixed to the compressor housing 14, and disposed in the compressor housing 14. The fixed scroll 9 has a fixed scroll end plate 9*a*, a fixed scroll peripheral wall 9*b*, and a fixed scroll spiral element 9*c*. The fixed scroll end plate 9*a* is located at a rear end of the fixed scroll 9, and formed in a disc shape extending in the radial direction of the driving shaft 5. The fixed scroll end plate 9*a* has a front surface 901 and a rear surface 902, and also has a second discharge recess 9*d* and a discharge port 9*e*. The front surface 901 is oriented in the front direction, that is, faces the movable scroll 11. The rear surface 902 is located opposite to the front surface 901, and oriented in the rear direction.

The second discharge recess 9*d* is recessed in the front direction from the rear surface 902. The fixed scroll 9 is fixed to the compressor housing 14, which causes the second discharge recess 9*d* to face the first discharge recess 14*d*. Thus, the first discharge recess 14*d* cooperates with the second discharge recess 9*d* to form a discharge chamber 35. The discharge chamber 35 communicates with the oil separation chamber 14*c* through the discharge passage 14*e*. The discharge port 9*e* extends in the longitudinal direction of the compressor through the fixed scroll end plate 9*a*, and communicates with the discharge chamber 35.

A discharge reed valve 39 and a retainer 41 are attached on the fixed scroll end plate 9*a* with a pin 37. The pin 37, the discharge reed valve 39, and the retainer 41 are disposed in the discharge chamber 35. The discharge reed valve 39 is elastically deformed to open and close the discharge port 9*e*. The retainer 41 adjusts an amount of elastic deformation of the discharge reed valve 39.

The fixed scroll peripheral wall 9*b* is connected to the fixed scroll end plate 9*a* at an outer periphery thereof, and has a cylindrical shape extending in the front direction, that is, toward the movable scroll 11. A suction port 9*f* is formed in the fixed scroll peripheral wall 9*b*. The suction port 9*f* extends through the fixed scroll peripheral wall 9*b* in a radial direction thereof. Thus, the suction port 9*f* opens into the compressor housing 14. The fixed scroll spiral element 9*c* is formed on the front surface 901 of the fixed scroll end plate 9*a*, and integrally formed with the fixed scroll peripheral wall 9*b* inside the fixed scroll peripheral wall 9*b*. The fixed scroll spiral element 9*c* spirally protrudes from the front surface 901 toward the movable scroll 11, and extends in a direction in which the driving axis O extends (hereinafter, called the driving axis O direction).

An oil supply passage 43 is formed in the fixed scroll 9. The oil supply passage 43 extends through the fixed scroll end plate 9*a* and the fixed scroll peripheral wall 9*b*. That is, a rear end of the oil supply passage 43 opens on the rear surface 902 of the fixed scroll end plate 9*a*, and a front end of the oil supply passage 43 opens on a front end surface of the fixed scroll peripheral wall 9*b*. The oil supply passage 43 communicates with the oil separation chamber 14*c* through the filter 23. The oil supply passage 43 may be designed in any shape as appropriate.

The movable scroll 11 is disposed in the compressor housing 14, and located between the fixed scroll 9 and the fixed block 15. The movable scroll 11 has a movable scroll end plate 11*a* and a movable scroll spiral element 11*b*. The movable scroll end plate 11*a* corresponds to the "end plate" in the present disclosure, and the movable scroll spiral element 11*b* corresponds to the "spiral element" in the present disclosure.

Figure 2:
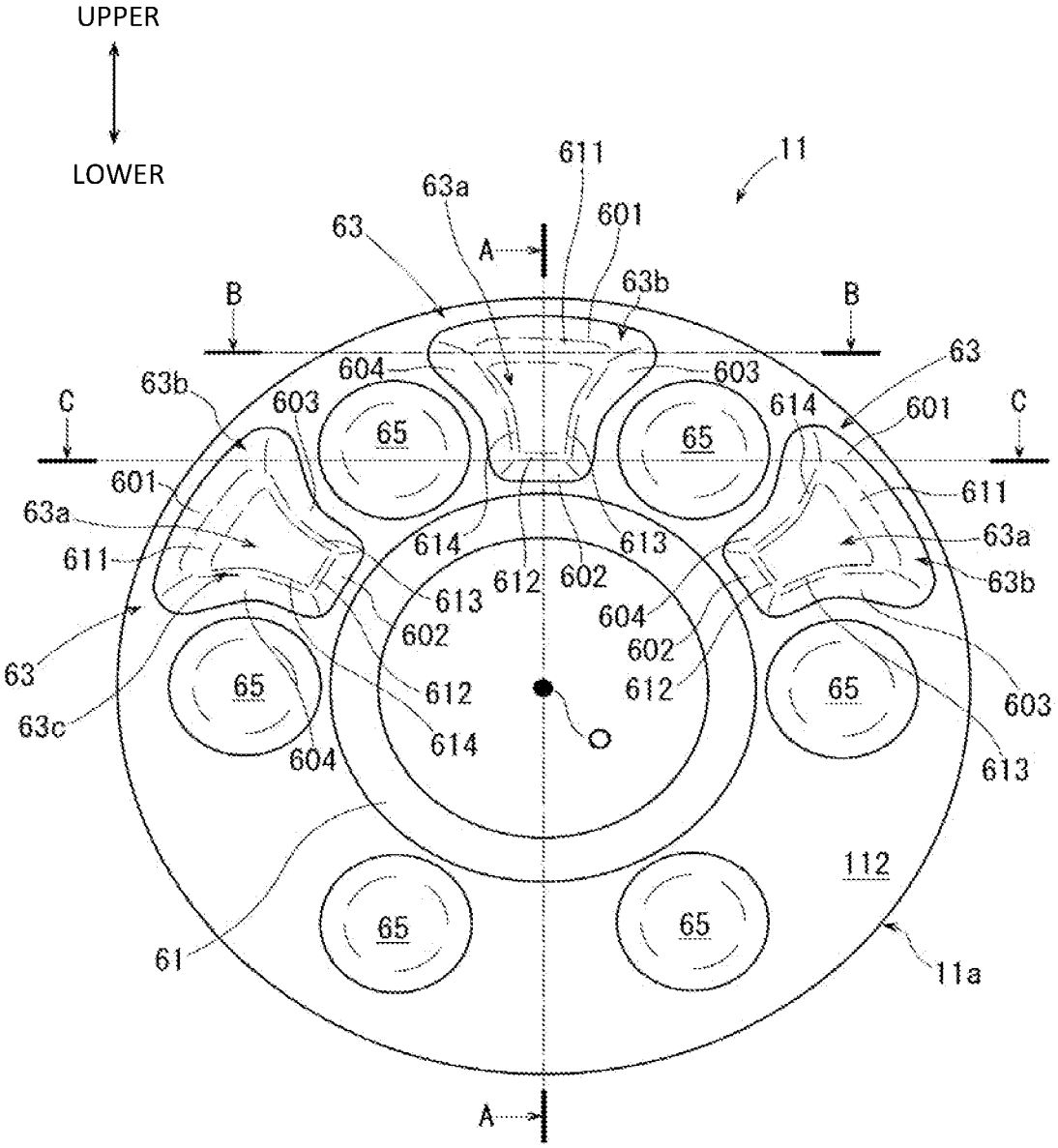
FIG. 2 is a front view illustrating a second scroll which is seen from a front of the second scroll according to the scroll compressor of the first embodiment.

As illustrated in FIGS. 2 and 3, the movable scroll end plate 11*a* is located at a front end of the movable scroll 11, and formed in a disc shape extending in the radial direction of the driving shaft 5. In other word, the movable scroll end plate 11*a* is formed in the disc shape extending orthogonally to the rotating axis X and the driving axis O. The movable scroll end plate 11*a* has a rear surface 111, a front surface 112, and an outer peripheral surface 113. The rear surface 111 corresponds to the "first surface" in the present disclosure, and the front surface 112 corresponds to the "second surface" in the present disclosure. The rear surface 111 is oriented in the rear direction, that is, faces the fixed scroll 9. The front surface 112 is located opposite to the rear surface 111 in the movable scroll end plate 11*a*, and oriented in the front direction. The outer peripheral surface 113 is located between the rear surface 111 and the front surface 112. The outer peripheral surface 113 extends in parallel with the rotating axis X and the driving axis O and extends around a periphery of the movable scroll end plate 11*a* in a circumferential direction thereof. The outer peripheral surface 113 is continuous with the rear surface 111 and the front surface 112. That is, the outer peripheral surface 113 serves as an outer edge portion of the movable scroll end plate 11*a*.

A holding portion 61, three first adjustment portions 63, and six accommodation portions 65 are formed in the movable scroll end plate 11*a*. Each of the first adjustment portions 63 corresponds to the "adjustment portion" in the present disclosure.

The holding portion 61 is disposed at a center position of the movable scroll end plate 11*a*, that is, at a position of the movable scroll end plate 11*a* close to the driving axis O. The holding portion 61 is formed in a cylindrical shape protruding in the front direction from the front surface 112. As illustrated in FIG. 1, in the holding portion 61, the bushing 50*a* is rotatably supported through a third radial bearing 45. With this configuration, the movable scroll 11 is connected to the driving shaft 5 through the bushing 50*a* and the eccentric pin 50 at a position, which is shifted from the rotating axis X.

As illustrated in FIG. 2, the first adjustment portions 63 have the same configuration, and are disposed in the circumferential direction of the movable scroll end plate 11*a*. The first adjustment portions 63 are each formed in a substantially rectangular shape that is recessed from the front surface 112 toward the rear surface 111. More specifically, the first adjustment portions 63 are each formed in the rectangular shape in which a portion closest to an outer periphery of the movable scroll end plate 11*a* extends longer than a portion closest to the driving axis O in the circumferential direction of the movable scroll end plate 11*a*. More specifically, the first adjustment portions 63 are each formed in the rectangular shape in which a portion closest to the outer peripheral surface 113 in the radial direction of the movable scroll end plate 11*a* extends longer than the portion closest to the driving axis O in the circumferential direction of the movable scroll end plate 11*a*.

Each of the first adjustment portions 63 is formed of a bottom surface 63*a*, a peripheral surface 63*b*, and a connection surface 63*c*. The bottom surface 63*a* is formed in a substantially rectangular and plane shape that extends in the radial direction of the movable scroll end plate 11*a* from a portion of the bottom surface 63*a* close to the outer periphery of the movable scroll end plate 11*a* toward the driving axis O, and extends in the circumferential direction of the movable scroll end plate 11*a*. Thus, the bottom surface 63*a* is a plane extending in parallel with the front surface 112. The bottom surface 63*a* is located closest to the rear surface 111 in the first adjustment portion 63, and serves as a bottom of the first adjustment portion 63. The portion of the bottom surface 63*a* close to the outer periphery of the movable scroll end plate 11*a* extends longer in the circumferential direction of the movable scroll end plate 11*a* than a portion of the bottom surface 63*a* close to the driving axis O.

The peripheral surface 63*b* extends around a periphery of the bottom surface 63*a*, and encloses the bottom surface 63*a*. As illustrated in FIG. 3, the peripheral surface 63*b* extends in the driving axis O direction from the bottom surface 63*a*. That is, the peripheral surface 63*b* extends in the front direction from the bottom surface 63*a* to the front surface 112.

As illustrated in FIG. 2, the peripheral surface 63*b* has a first peripheral surface 601, a second peripheral surface 602, a third peripheral surface 603, and a fourth peripheral surface 604. The first peripheral surface 601 is located closest to the outer periphery of the movable scroll end plate 11*a* in the peripheral surface 63*b*, that is, closest to the outer peripheral surface 113. The second peripheral surface 602 is located closest to the driving axis O in the peripheral surface 63*b*. The second peripheral surface 602 faces the first peripheral surface 601 in the radial direction of the movable scroll end plate 11*a*.

The third peripheral surface 603 is located between the first peripheral surface 601 and the second peripheral surface 602 in the peripheral surface 63*b*, and connects the first peripheral surface 601 to the second peripheral surface 602. In the peripheral surface 63*b*, the fourth peripheral surface 604 faces the third peripheral surface 603 in the circumferential direction of the movable scroll end plate 11*a*, and is located between the first peripheral surface 601 and the second peripheral surface 602. The fourth peripheral surface 604 connects the first peripheral surface 601 to the second peripheral surface 602.

In the peripheral surface 63*b*, the first peripheral surface 601 extends longer in the circumferential direction of the movable scroll end plate 11*a* than the second peripheral surface 602. As the third peripheral surface 603 and the fourth peripheral surface 604 extend from the first peripheral surface 601 to the second peripheral surface 602, the third peripheral surface 603 and the fourth peripheral surface 604 approach each other in the circumferential direction of the movable scroll end plate 11*a*.

The connection surface 63*c* is located between the bottom surface 63*a* and the peripheral surface 63*b*, and connects the bottom surface 63*a* to the peripheral surface 63*b*. The connection surface 63*c* has a first connection portion 611, a second connection portion 612, a third connection portion 613, and a fourth connection portion 614.

Figure 4:
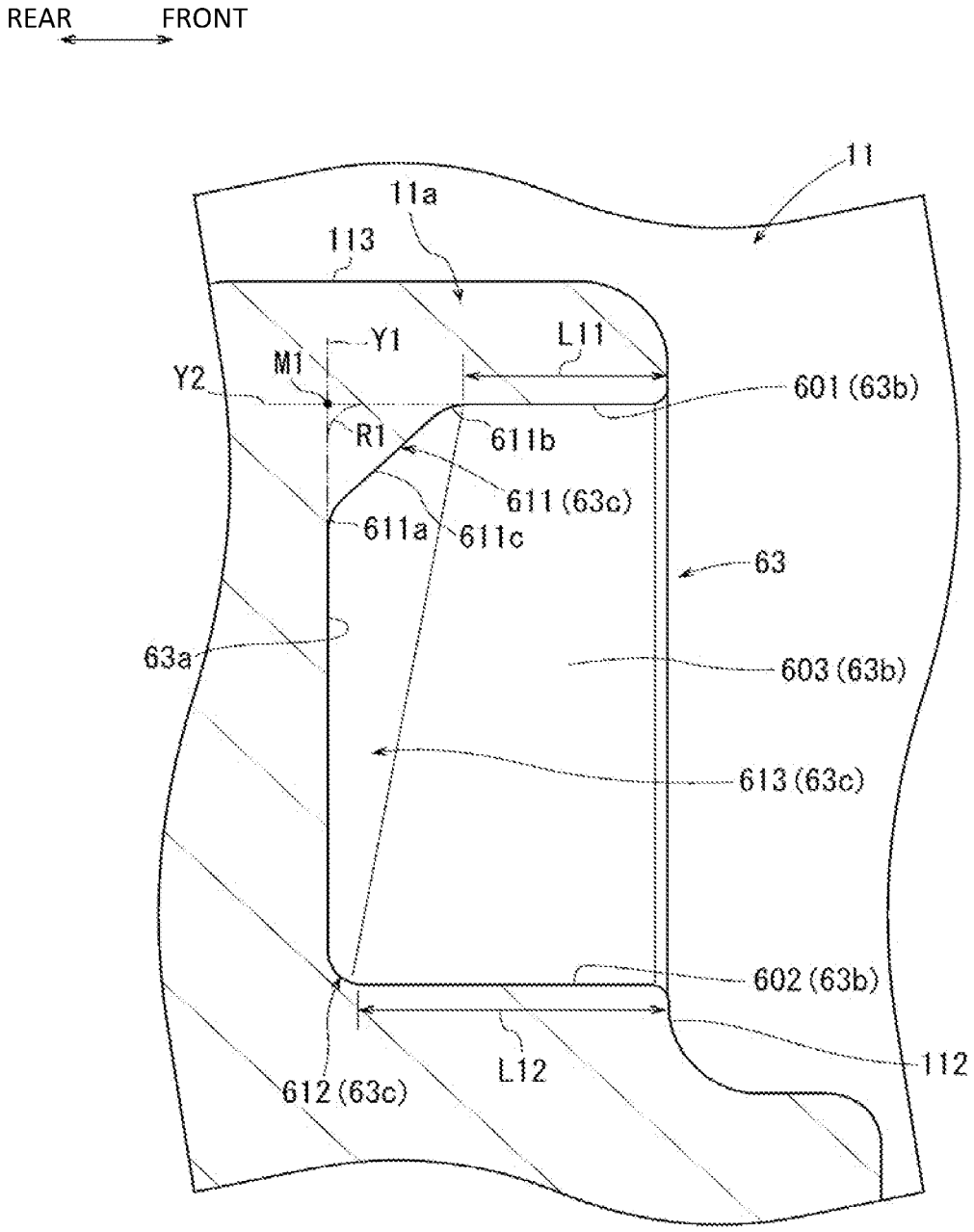
FIG. 4 is a cross-sectional view taken along the line A-A of FIG. 2, illustrating an enlarged main part of an adjustment portion according to the scroll compressor of the first embodiment.
Figure 5:
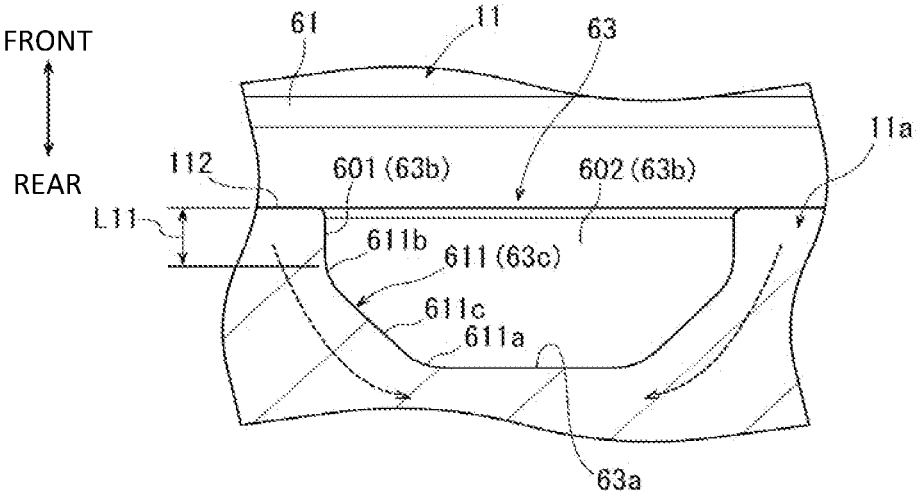
FIG. 5 is a cross-sectional view taken along a line B-B of FIG. 2, illustrating an enlarged main part of the adjustment portion according to the scroll compressor of the first embodiment.
Figure 6:
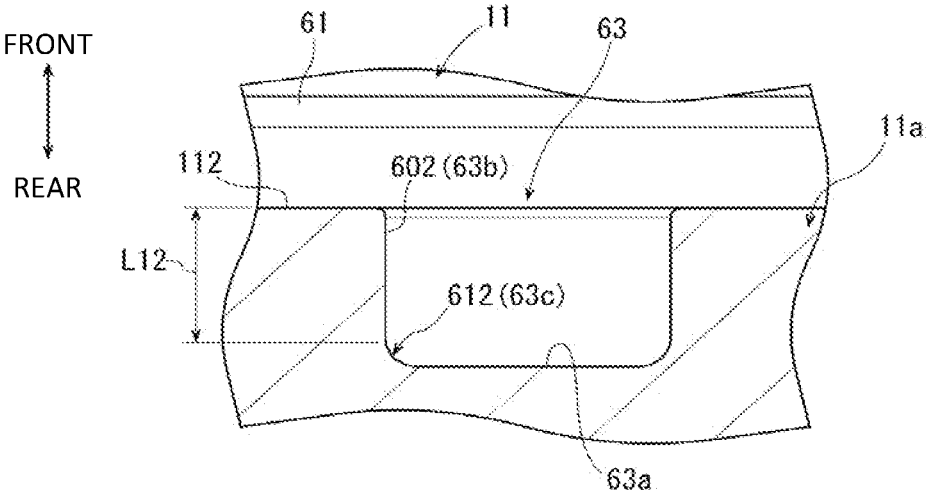
FIG. 6 is a cross-sectional view taken along a line C-C of FIG. 2, illustrating an enlarged main part of the adjustment portion according to the scroll compressor of the first embodiment.

As illustrated in FIGS. 4 and 5, the first connection portion 611 is located between the bottom surface 63*a* and the first peripheral surface 601, and connects the bottom surface 63*a* to the first peripheral surface 601. As illustrated in FIGS. 4 and 6, the second connection portion 612 is located between the bottom surface 63*a* and the second peripheral surface 602. As illustrated in FIG. 2, the third connection portion 613 is located between the bottom surface 63*a* and the third peripheral surface 603. The fourth connection portion 614 is located between the bottom surface 63*a* and the fourth peripheral surface 604. In the connection surface 63*c*, the first connection portion 611 is located closest to the outer periphery of the movable scroll end plate 11*a*, and the second connection portion 612 is located closest to the driving axis O.

As illustrated in FIGS. 4 and 5, the first connection portion 611 has a bottom surface side first connection part 611*a*, a peripheral surface side first connection part 611*b*, and a first flat part 611*c*. The bottom surface side first connection part 611*a* is connected to the bottom surface 63*a*, and extends to be curved toward the first peripheral surface 601. The peripheral surface side first connection part 611*b* is connected to the first peripheral surface 601, and extends to be curved toward the bottom surface 63*a*. The first flat part 611*c* is located between the bottom surface side first connection part 611*a* and the peripheral surface side first connection part 611*b*. The first flat part 611*c* extends in a flat shape, and connects the bottom surface side first connection part 611*a* to the peripheral surface side first connection part 611*b*.

With the bottom surface side first connection part 611*a*, the peripheral surface side first connection part 611*b*, and the first flat part 611*c*, the first connection portion 611 has an overall shape that is upwardly inclined from the bottom surface 63*a* toward the first peripheral surface 601, and connects the bottom surface 63*a* to the first peripheral surface 601. In other word, the first connection portion 611 has a shape in which a portion connecting the bottom surface 63*a* to the first peripheral surface 601 is chamfered, when the first adjustment portion 63 is seen in a cross-section taken along a line A-A of FIG. 2. The cross-section taken along the line A-A corresponds to the reference cross-section in the present disclosure, and the cross-section is a cross-section of the movable scroll end plate 11*a* extending in the driving axis O direction through the first peripheral surface 601, the second peripheral surface 602, and the driving axis O.

On the other hand, as illustrated in FIGS. 4 and 6, the second connection portion 612 does not have the bottom surface side first connection part 611*a*, the peripheral surface side first connection part 611*b*, and the first flat part 611*c*, unlike the first connection portion 611. When seen in the cross-section taken along the line A-A, as illustrated in FIG. 4, the second connection portion 612 is curved in an arc shape with a predetermined radius of curvature, and connects the bottom surface 63*a* to the second peripheral surface 602.

The third connection portion 613 and the fourth connection portion 614 illustrated in FIG. 2 are symmetrical to each other in the circumferential direction of the movable scroll end plate 11*a*. The third connection portion 613 is curved in an arc shape and connects the bottom surface 63*a* to the third peripheral surface 603, and the fourth connection portion 614 is curved in an arc shape and connects the bottom surface 63*a* to the fourth peripheral surface 604. Furthermore, the third connection portion 613 and the fourth connection portion 614 are located between the first connection portion 611 and the second connection portion 612 in the radial direction of the movable scroll end plate 11*a*. Thus, the third connection portion 613 and the fourth connection portion 614 are each connected to the first connection portion 611 and the second connection portion 612.

As illustrated in FIG. 4, in the cross-section taken along the line A-A, the followings are assumed: a first imaginary line Y1 extending straight from the bottom surface 63*a* toward the outer periphery of the movable scroll end plate 11*a*; a second imaginary line Y2 extending straight from the first peripheral surface 601 toward the first imaginary line Y1; and a first imaginary arc R1 equal to an arc of the second connection portion 612. The first imaginary arc R1 is in contact with the first imaginary line Y1 and the second imaginary line Y2, and located between the bottom surface 63*a* and the first peripheral surface 601. As a result, the first connection portion 611, more specifically, the bottom surface side first connection part 611*a*, the peripheral surface side first connection part 611*b*, and the first flat part 611*c* face an intersection M1 of the first imaginary line Y1 and the second imaginary line Y2 across the first imaginary arc R1.

As compared with a case where the bottom surface 63*a* and the second peripheral surface 602 are connected in an arc shape by the second connection portion 612, the bottom surface 63*a* and the first peripheral surface 601 are more gently connected by the first connection portion 611. Although not illustrated in detail, the first connection portion 611 is also more gently curved than the third connection portion 613 and the fourth connection portion 614.

Thus, the first connection portion 611 more gently connects the bottom surface 63*a* to the first peripheral surface 601 than the second connection portion 612 connects the bottom surface 63*a* to the second peripheral surface 602 in the arc shape, so that the first peripheral surface 601 extends shorter in the driving axis O direction than the second peripheral surface 602. Specifically, while the second peripheral surface 602 extends by a second length L12 from the bottom surface 63*a* to the front surface 112, the first peripheral surface 601 extends by a first length L11 shorter than the second length L12 from the bottom surface 63*a* to the front surface 112.

As described above, the third peripheral surface 603 connects the first peripheral surface 601 to the second peripheral surface 602. In addition, the third connection portion 613 connects the first connection portion 611 to the second connection portion 612. This means that in the third connection portion 613, a portion close to the first connection portion 611 more gently connects the bottom surface 63*a* to the third peripheral surface 603, as compared with a portion close to the second connection portion 612. With these configurations, the third peripheral surface 603 extends by the second length L12 from the bottom surface 63*a* to the front surface 112 at a connection portion between the third peripheral surface 603 and the second peripheral surface 602, whereas the third peripheral surface 603 extends by the first length L11 from the bottom surface 63*a* to the front surface 112 at a connection portion between the third peripheral surface 603 and the first peripheral surface 601. That is, a length of the third peripheral surface 603 in the driving axis O direction is gradually decreased from the second length L12 to the first length 11, as the third peripheral surface 603 extends from the second peripheral surface 602 to the first peripheral surface 601. Although not illustrated, a length of the fourth peripheral surface 604 in the driving axis O direction is also gradually decreased from the second length L12 to the first length 11, as the fourth peripheral surface 604 extends from the second peripheral surface 602 to the first peripheral surface 601. The third peripheral surface 603, the fourth peripheral surface 604, the third connection portion 613, and the fourth connection portion 614 may be designed in any shape as appropriate.

As illustrated in FIG. 2, the accommodation portions 65 have the same configuration, and are disposed in the circumferential direction of the movable scroll end plate 11*a*. The accommodation portions 65 are each formed in a substantially columnar shape that is recessed from the front surface 112 toward the rear surface 111. The number of the first adjustment portions 63 and the number of the accommodation portions 65 formed in the movable scroll end plate 11*a* may be designed as appropriate.

As illustrated in FIG. 3, the movable scroll spiral element 11*b* is integrally formed with the rear surface 111 of the movable scroll end plate 11*a*. The movable scroll spiral element 11*b* spirally protrudes from the rear surface 111 toward the fixed scroll 9 in the rear direction, that is, in a direction in which the rotating axis X extends and the driving axis O direction. As illustrated in FIG. 1, an air supply port 11*d* is disposed near a center of the movable scroll spiral element 11*b*. The air supply port 11*d* opens at a front end of the movable scroll spiral element 11*b*, and extends in the longitudinal direction of the compressor to the movable scroll end plate 11*a* through the movable scroll spiral element 11*b*. As illustrated in FIGS. 2 and 3, for ease of explanation, the air supply port 11*d* is not illustrated. This goes for FIGS. 8 and 9 as described later.

Figure 7:
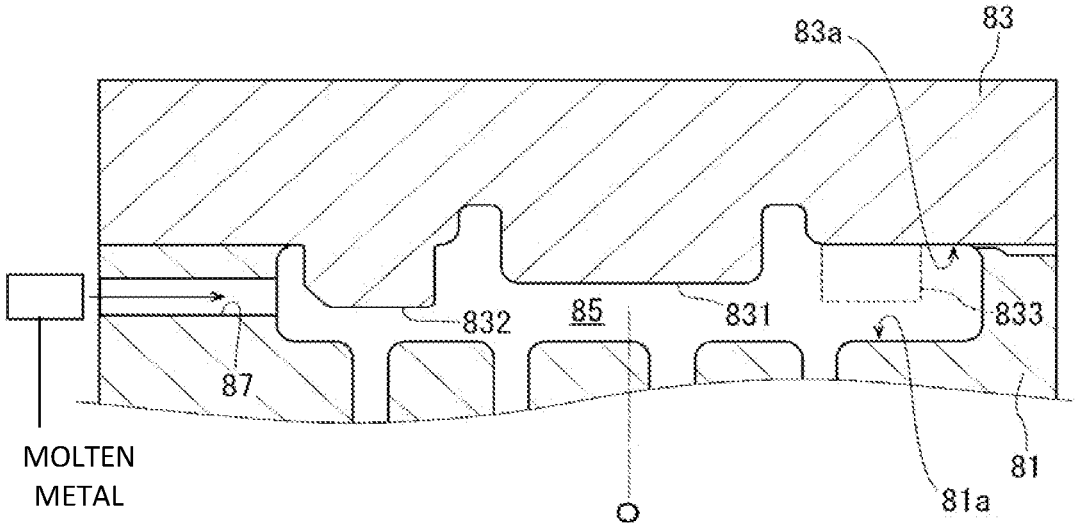
FIG. 7 is a schematic view illustrating a process of producing the second scroll according to the scroll compressor of the first embodiment.

In forming such a movable scroll 11, firstly, a preparation process of preparing a first casting mold 81 and a second casting mold 83 illustrated in FIG. 7 is performed. The first casting mold 81 has a first forming surface 81*a*, and the second casting mold 83 has a second forming surface 83*a*. When the first casting mold 81 and the second casting mold 83 are clamped while the first forming surface 81*a* and the second forming surface 83*a* face each other, a first mold cavity 85 is defined by the first forming surface 81*a* and the second forming surface 83*a*.

Here, the second forming surface 83*a* has a holding portion forming part 831 used for forming the holding portion 61, a first adjustment portion forming part 832 used for forming the first adjustment portions 63, and an accommodation portion forming part 833 used for forming the accommodation portions 65.

A first pouring hole 87 is formed in the first casting mold 81. The first pouring hole 87 is connected to the first mold cavity 85. The first pouring hole 87 is connected to a portion of the first mold cavity 85 to form the outer peripheral surface 113 of the movable scroll end plate 11*a*, that is, to form an outer peripheral portion of the movable scroll end plate 11*a*. The first pouring hole 87 may be formed in the second casting mold 83, and connected to the outer peripheral portion of the movable scroll end plate 11*a*.

Next, a casting process is performed. In the casting process, as indicated by an arrow in FIG. 7, which is drawn by a solid line, molten metal is supplied from the first pouring hole 87, and poured into the first mold cavity 85 through the first pouring hole 87. Here, while the molten metal is pressurized as appropriate by a plunger (not illustrated), the molten metal is poured into the first mold cavity 85. The molten metal poured into the first mold cavity 85 is locally pressurized by a squeeze pin (not illustrated).

The first pouring hole 87 is connected to a portion of the first mold cavity 85 to be the outer peripheral portion of the movable scroll end plate 11*a*. Accordingly, the molten metal supplied through the first pouring hole 87, in the first mold cavity 85, flows from a portion to form the outer peripheral portion of the movable scroll end plate 11*a* toward the driving axis O, that is, the center of the movable scroll end plate 11*a*. Then, when the first mold cavity 85 is filled with the molten metal, the pouring of the molten metal completes. Consequently, the casting process ends.

Next, a finishing process is performed. In the finishing process, the molten metal is cooled and solidified in the first mold cavity 85 to form a preformed workpiece (not illustrated) of the movable scroll 11. Then, when the preformed workpiece is removed from the first mold cavity 85, and a finishing treatment such as polishing is applied on the preformed workpiece, the forming of the movable scroll 11 completes. Consequently, the finishing process ends.

Thus, in the first embodiment, not only the movable scroll spiral element 11*b* but also the holding portion 61, the first adjustment portions 63, and the accommodation portions 65 are integrally formed with the movable scroll end plate 11*a* at the same time by casting the movable scroll 11. That is, in the first adjustment portions 63 formed by the casting, as described above, the first adjustment portion forming part 832 of the second forming surface 83*a* is formed such that the length of the first peripheral surface 601 in the driving axis O direction is shorter than the length of the second peripheral surface 602 in the driving axis O direction, the first connection portion 611 is more gently curved than the second connection portion 612, and the lengths of the third peripheral surface 603 and the fourth peripheral surface 604 in the driving axis O direction are gradually decreased as the third peripheral surface 603 and the fourth peripheral surface 604 extend from the second peripheral surface 602 to the first peripheral surface 601. Although neither described in detail nor illustrated, the fixed scroll 9 is also formed by casting.

As illustrated in FIG. 1, in the compressor housing 14, the fixed scroll spiral element 9*c* of the fixed scroll 9 and the movable scroll spiral element 11*b* of the movable scroll 11 are engaged with each other. With this configuration, the fixed scroll end plate 9*a*, the fixed scroll spiral element 9*c*, the movable scroll end plate 11*a*, and the movable scroll spiral element 11*b* define a compression chamber 49 between the fixed scroll 9 and the movable scroll 11. The compression chamber 49 communicates with the discharge port 9*e*.

A thrust plate 51 is disposed between the fixed scroll 9 and the fixed block 15, and between the movable scroll 11 and the fixed block 15. The fixed scroll 9 and the movable scroll 11 are in contact with the fixed block 15 through the thrust plate 51. The thrust plate 51 is made of a thin metal plate.

The movable scroll end plate 11*a* and the thrust plate 51 define a back-pressure chamber 53 in the boss 15*a* of the fixed block 15. The back-pressure chamber 53 communicates with the air supply port 11*d*.

In the movable scroll 11, a ring 47 formed in a cylindrical shape is accommodated in each of the accommodation portions 65 of the movable scroll end plate 11*a*. The rings 47 and the anti-rotation pins 31 are coupled by inserting end portions of the anti-rotation pins 31 to the rings 47, respectively. The anti-rotation pins 31 and the rings 47 constitute an anti-rotation mechanism 16. Thus, the fixed block 15, the thrust plate 51, and the movable scroll 11 are coupled by the anti-rotation mechanism 16.

In this compressor, the electric motor 7 is controlled by the inverter to operate, which rotates the driving shaft 5 about the rotating axis X. The rotation of the driving shaft 5 rotates the movable scroll 11. The rotation of the movable scroll 11 is regulated by the anti-rotation mechanism 16, so that the movable scroll 11 only orbits the driving axis O, which is shifted from the rotating axis X. That is, the movable scroll 11 rotates about the driving axis O relative to the fixed scroll 9. This causes the movable scroll end plate 11*a* to slide on an end of the fixed scroll spiral element 9*c*, and causes the movable scroll spiral element 11*b* to slide relative to the fixed scroll spiral element 9*c*. With this movement, the refrigerant gas in the suction chamber 17 flows into the suction port 9*f* through the suction passage 55, and then, is sucked into the compression chamber 49 through the suction port 9*f*. The compression chamber 49 is reduced in volume by the rotation of the movable scroll 11, thereby compressing the refrigerant gas inside the compression chamber 49.

The refrigerant gas of high pressure, which has been compressed in the compression chamber 49, is discharged to the discharge chamber 35 through the discharge port 9*e*, and flows from the discharge chamber 35 to the oil separation chamber 14*c* through the discharge passage 14*e*. While the refrigerant gas of the high pressure flows between the outer peripheral surface 21*a* of the separation cylinder 21 and the inner peripheral surface 140 of the oil separation chamber 14*c* again and again, lubricant oil is separated from the refrigerant gas of the high pressure. Then, the refrigerant gas is discharged from the discharge opening 14*f* through an inside of the separation cylinder 21.

On the contrary, the lubricant oil separated from the refrigerant gas is stored in the oil separation chamber 14*c*. The lubricant oil flows into the oil supply passage 43 through the filter 23, and is supplied to a sliding portion between the fixed scroll 9 and the movable scroll 11 to smooth the sliding portion. The lubricant oil flowing through the oil supply passage 43 is also supplied to the suction chamber 17, or the like, in addition to a space between the second radial bearing 27 and the driving shaft 5.

The part of the refrigerant gas of the high pressure, which has been compressed in the compression chamber 49, is supplied to the back-pressure chamber 53 through the air supply port 11*d*. This increases pressure in the back-pressure chamber 53. As a result, the movable scroll 11 is urged toward the compression chamber 49 through the thrust plate 51 by the pressure in the back-pressure chamber 53. The movable scroll 11 is urged toward the compression chamber 49 also by an elastic force of the thrust plate 51.

In this compressor, in order to increase a size of the compression chamber 49, the fixed scroll spiral element 9*c* and the movable scroll spiral element 11*b* are each formed longer in the driving axis O direction, as compared with those of the conventional compressor. With this configuration, the movable scroll 11 has the first adjustment portions 63 that are more deeply recessed into the movable scroll end plate 11*a* to adjust a center-of-gravity of the movable scroll 11.

In this compressor, in forming the movable scroll 11 by the casting, the molten metal flows from the portion of the first mold cavity 85 to form the outer peripheral portion of the movable scroll end plate 11*a* toward the driving axis O. That is, the first peripheral surface 601 is located upstream of the second peripheral surface 602 in a flowing direction of the molten metal, and the first connection portion 611 is located upstream of the second connection portion 612 in the flowing direction of the molten metal.

In this compressor, the connection surface 63*c* of each of the first adjustment portions 63 has the first connection portion 611, the second connection portion 612, the third connection portion 613, and the fourth connection portion 614. Here, the first connection portion 611 connects the first peripheral surface 601 of the peripheral surface 63*b* to the bottom surface 63*a*, that is, the first connection portion 611 is located closest to the outer periphery of the movable scroll end plate 11*a*, of the connection surface 63*c*. In contrast, the second connection portion 612 connects the second peripheral surface 602 of the peripheral surface 63*b* to the bottom surface 63*a*, that is, the second connection portion 612 is located closest to the driving axis O, of the connection surface 63*c*. As described above, the first connection portion 611 faces the intersection M1 of the first imaginary line Y1 and the second imaginary line Y2 across the first imaginary arc R1, and connects the bottom surface 63*a* to the first peripheral surface 601 with a gentler curve than that of the second connection portion 612 formed in an arc shape.

While the second peripheral surface 602 extends from the bottom surface 63*a* to the front surface 112 by the second length L12, the first peripheral surface 601 extends from the bottom surface 63*a* to the front surface 112 by the first length L11 shorter than the second length L12.

In this compressor, these configurations increase fluidity of the molten metal to form the first peripheral surface 601 and the first connection portion 611 when the movable scroll 11 is casted, as indicated in arrows of FIG. 5, which are drawn by a broken line. In other word, the molten metal suitably flows on portions of the first mold cavity 85 to form the first peripheral surface 601 and the first connection portion 611. For this reason, in this compressor, even when the first adjustment portions 63 are deeply recessed, the first adjustment portions 63 each including the first peripheral surface 601 and the first connection portion 611 are suitably formed.

Thus, in this compressor, the fixed scroll spiral element 9*c* and the movable scroll spiral element 11*b* are made longer in the driving axis O direction to increase the compression chamber 49 in size, and the center-of-gravity of the movable scroll 11 is suitably adjusted by the first adjustment portions 63. In addition, in this compressor, the fluidity of the molten metal to form the first peripheral surface 601 and the first connection portion 611 is increased, thereby making it difficult to reduce an efficiency of producing the compressor, even when the first adjustment portions 63 are formed so as to be recessed deeply.

Therefore, the compressor according to the first embodiment is superior in quietness while a capacity for compressing the refrigerant gas is increased, and produced at low cost.

Specifically, in this compressor, the first connection portion 611 has the bottom surface side first connection part 611*a*, the peripheral surface side first connection part 611*b*, and the first flat part 611*c*. With this configuration, when each of the first adjustment portions 63 is seen in the cross-section taken along the line A-A, the first connection portion 611, which connects the bottom surface 63*a* to the first peripheral surface 601, has the chamfered shape. Due to the first flat part 611*c*, the fluidity of the molten metal to form the first connection portion 611 is sufficiently increased.

In this compressor, the lengths of the third peripheral surface 603 and the fourth peripheral surface 604 of the peripheral surface 63*b* in the driving axis O direction are gradually shortened as the third peripheral surface 603 and the fourth peripheral surface 604 extends from the second peripheral surface 602 to the first peripheral surface 601. This also increases the fluidity of the molten metal to form the first peripheral surface 601 and the first connection portion 611.

In this compressor, in forming the first adjustment portions 63, the portion required for securing the fluidity of the molten metal to form the connection surface 63*c*, that is, the first connection portion 611, is formed in a gentle curve, so that all of the first connection portion 611 to the fourth connection portion 614 need not to be formed in a gentle curve like the first connection portion 611. Accordingly, in this compressor, while the efficiency of producing the compressor is increased as described above, a degree of freedom in design of the connection surface 63*c* and therefore a degree of freedom in design of the first adjustment portions 63 is also increased. For that reason, each of the first adjustment portions 63 is formed in a shape suitable for adjusting the center-of-gravity of the movable scroll 11. As a result, the center-of-gravity of the movable scroll 11 is suitably adjusted by the first adjustment portions 63, which causes the center-of-gravity of the movable scroll 11 to approach the driving axis O suitably.

Second Embodiment

Figure 8:
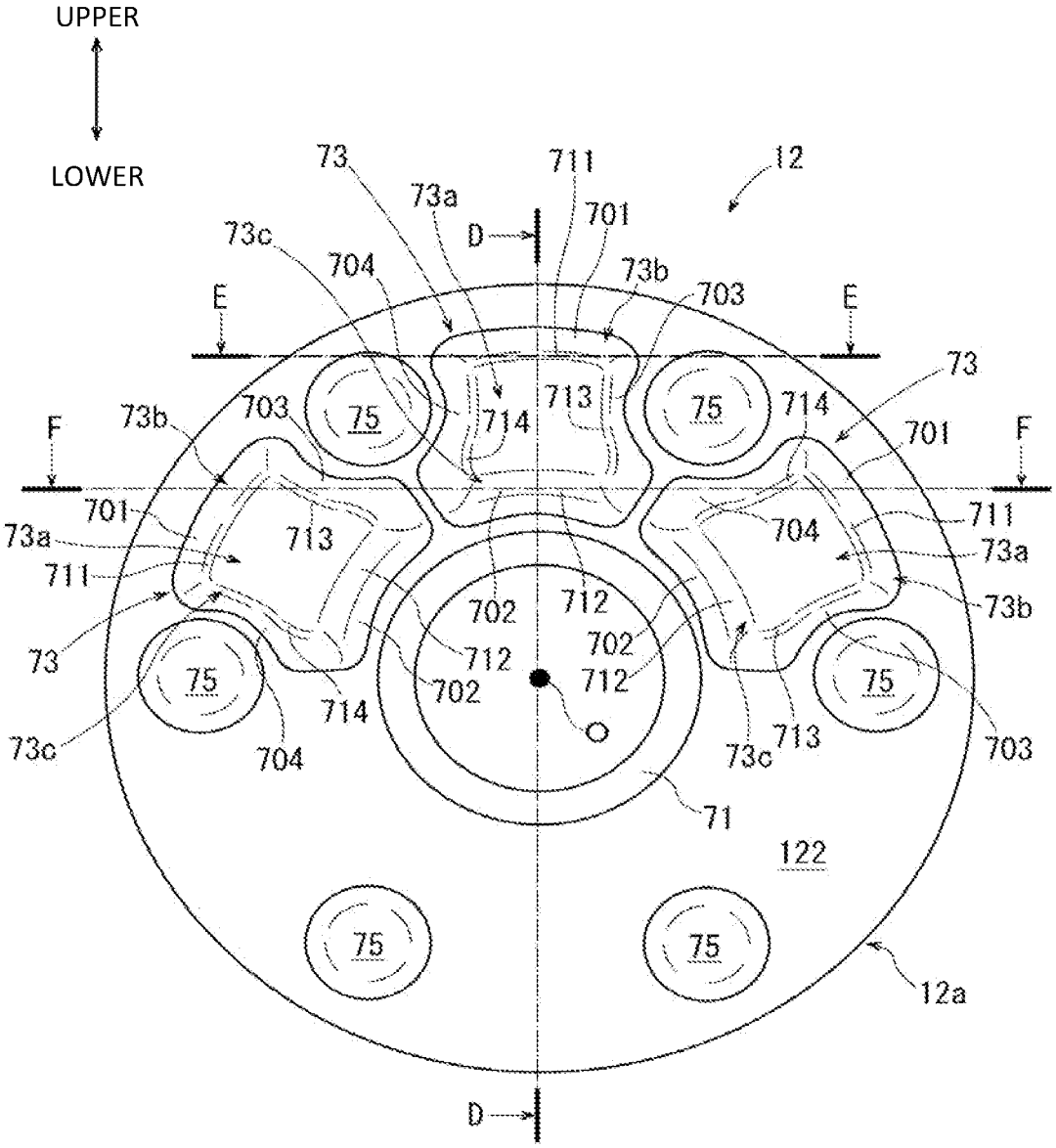
FIG. 8 is a front view illustrating a second scroll which is seen from a front of the second scroll according to a scroll compressor of a second embodiment.
Figure 9:
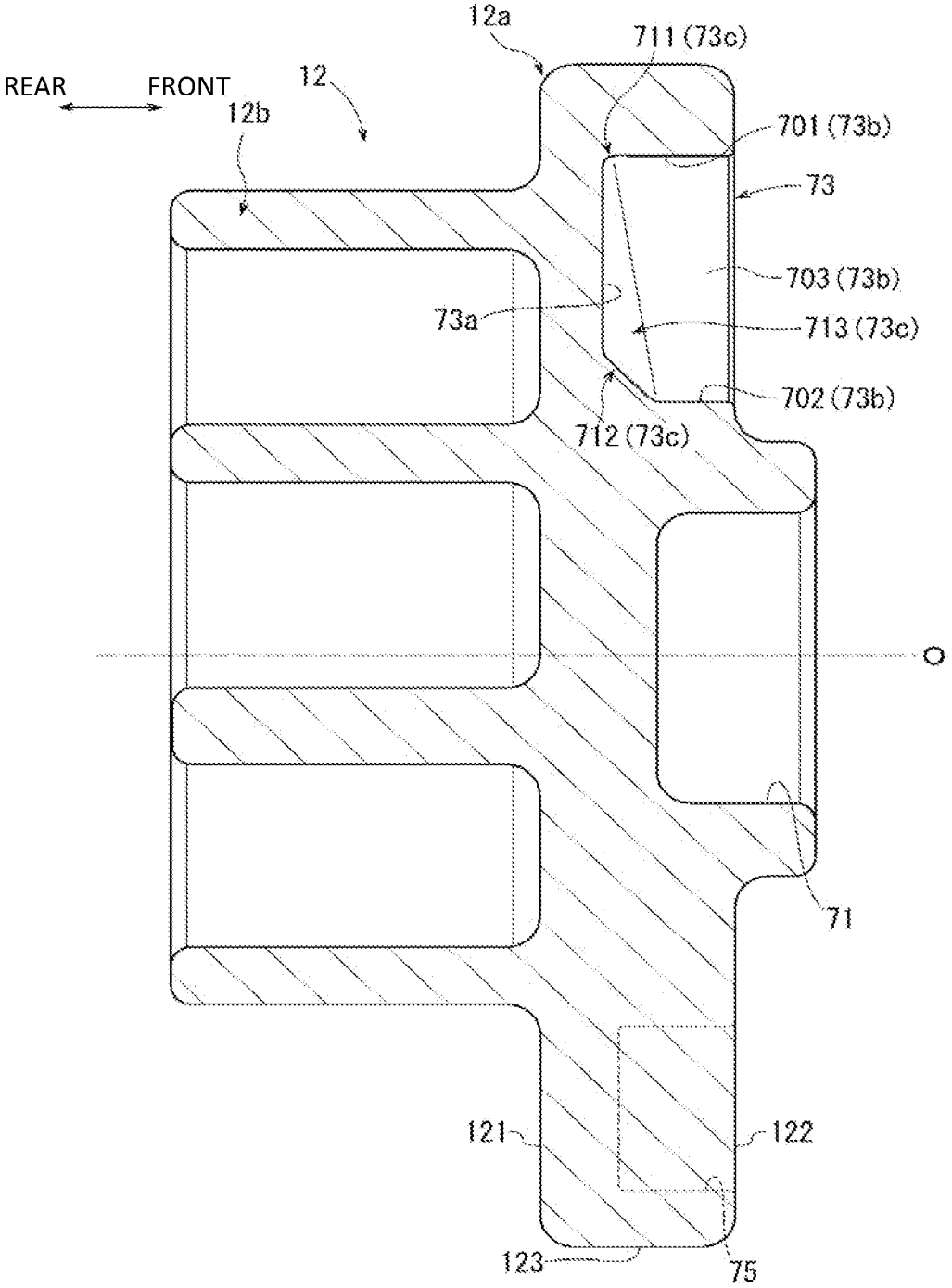
FIG. 9 is a cross-sectional view taken along a line D-D of FIG. 8 according to the scroll compressor of the second embodiment.

The compressor of the second embodiment includes a movable scroll 12 illustrated in FIGS. 8 and 9, instead of the movable scroll 11. The movable scroll 12 also corresponds to the "second scroll" in the present embodiment.

The movable scroll 12 has a movable scroll end plate 12*a* and a movable scroll spiral element 12*b*. The movable scroll end plate 12*a* corresponds to the "end plate" in the present disclosure, and the movable scroll spiral element 12*b* also corresponds to the "spiral element" in the present disclosure. The movable scroll end plate 12*a* is located at a front end of the movable scroll 12, and formed in a disc shape extending in a radial direction of the driving shaft 5. The movable scroll end plate 12*a* has a rear surface 121, a front surface 122, and an outer peripheral surface 123. The rear surface 121 also corresponds to the "first surface" in the present disclosure, and the front surface 122 also corresponds to the "second surface" in the present disclosure. The rear surface 121 faces the fixed scroll 9. The front surface 122 is located opposite to the rear surface 121, and oriented in the front direction. The outer peripheral surface 123 is located between the rear surface 121 and the front surface 122. The outer peripheral surface 123 extends in parallel with the rotating axis X and the driving axis O, extends around a periphery of the movable scroll end plate 12*a* in a circumferential direction thereof, and is continuous with the rear surface 121 and the front surface 122. That is, the outer peripheral surface 123 serves as an outer edge portion of the movable scroll end plate 12*a*.

As illustrated in FIG. 8, a holding portion 71, three second adjustment portions 73, and six accommodation portions 75 are formed in the movable scroll end plate 12*a*. Each of the second adjustment portions 73 also corresponds to the "adjustment portion" in the present disclosure. The holding portion 71 and the accommodation portions 75 in the second embodiment have the same configuration as those of the holding portion 61 and the accommodation portions 65 in the first embodiment, except only that the holding portion 71 and the accommodation portions 75 each have a smaller diameter than those of the holding portion 61 and the accommodation portions 65. The number of the second adjustment portions 73 and the number of the accommodation portions 75 may be designed as appropriate.

The second adjustment portions 73 have the same configuration, and are disposed in the circumferential direction of the movable scroll end plate 12*a*. The second adjustment portions 73 are each formed in a substantially rectangular shape that is recessed from the front surface 122 toward the rear surface 121. More specifically, the second adjustment portions 73 are each formed in a rectangular shape in which a portion closest to the driving axis O extends longer in the circumferential direction of the movable scroll end plate 12*a* than a portion closest to an outer periphery of the movable scroll end plate 12*a*. In other word, the second adjustment portions 73 are each formed in the rectangular shape in which a portion closest to the driving axis O in a radial direction of the movable scroll end plate 12*a* extends longer in the circumferential direction of the movable scroll end plate 12*a* than a portion closest to the outer peripheral surface 123.

Each of the second adjustment portions 73 is formed of a bottom surface 73*a*, a peripheral surface 73*b*, and a connection surface 73*c*. The bottom surface 73*a* is formed in a substantially rectangular and plane shape that extends in the radial direction of the movable scroll end plate 12*a* from a portion of the bottom surface 73*a* close to the outer periphery of the movable scroll end plate 12*a* toward the driving axis O, and extends in the circumferential direction of the movable scroll end plate 12*a*. Thus, the bottom surface 73*a* is a plane extending in parallel with the front surface 122. The bottom surface 73*a* is located closest to the rear surface 121 in each of the second adjustment portions 73, and serves as a bottom of the second adjustment portion 73. A portion of the bottom surface 73*a* close to the driving axis O extends longer in the circumferential direction of the movable scroll end plate 12*a* than a portion of the bottom surface 73*a* close to the outer periphery of the movable scroll end plate 12*a*.

Figure 10:
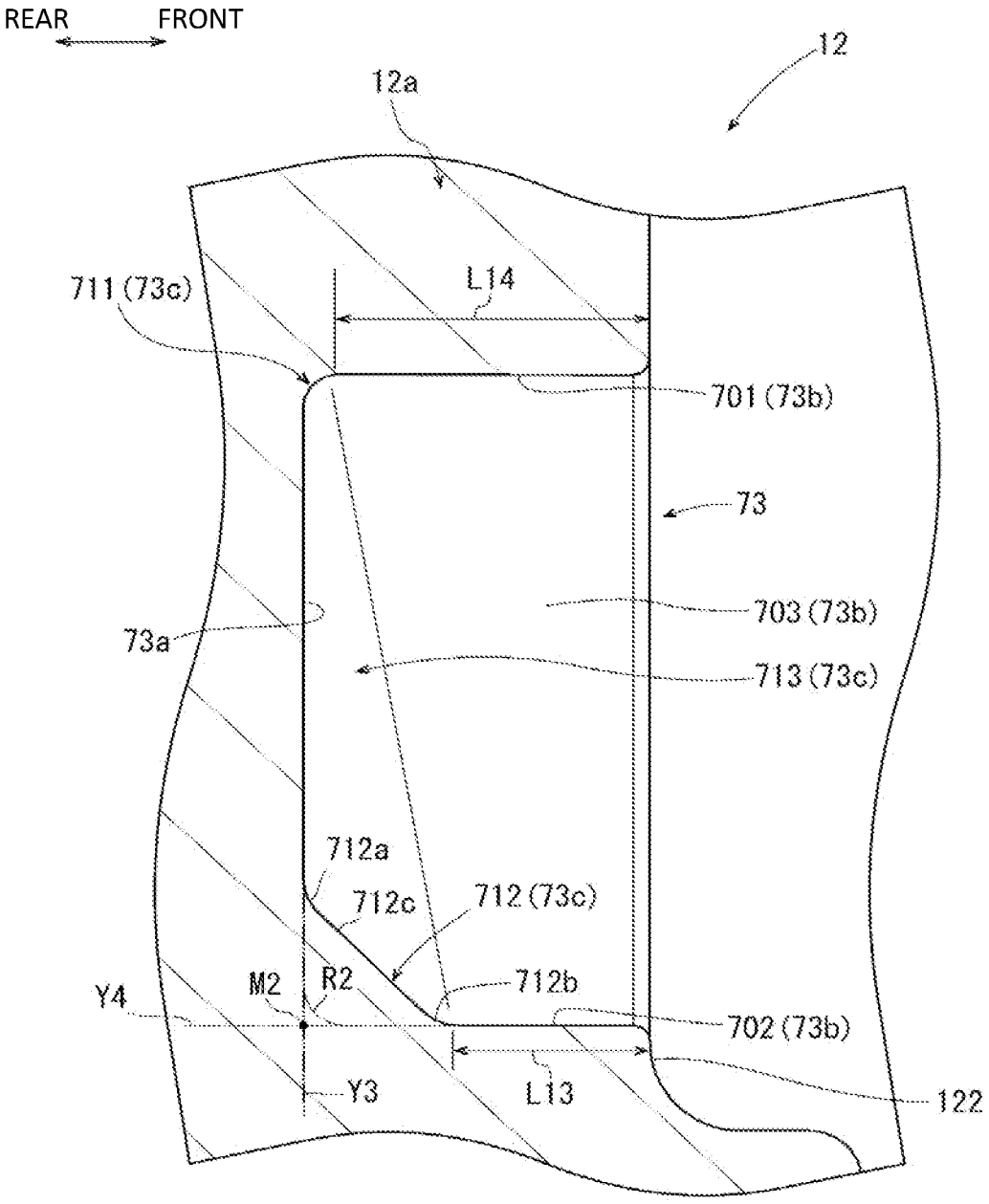
FIG. 10 is a cross-sectional view taken along the line D-D of FIG. 8, illustrating an enlarged main part of an adjustment portion according to the scroll compressor of the second embodiment.

The peripheral surface 73*b* extends around a periphery of the bottom surface 73*a*, and encloses the bottom surface 73*a*. As illustrated in FIG. 10, the peripheral surface 73*b* extends in the driving axis O direction from the bottom surface 73*a*.

As illustrated in FIG. 8, the peripheral surface 73*b* has a first peripheral surface 701, a second peripheral surface 702, a third peripheral surface 703, and a fourth peripheral surface 704. The first peripheral surface 701 is located closest to the outer periphery of the movable scroll end plate 12*a*, in the peripheral surface 73*b*, that is, close to the outer peripheral surface 123. The second peripheral surface 702 is located closest to the driving axis O in the peripheral surface 73*b*. The second peripheral surface 702 faces the first peripheral surface 701 in the radial direction of the movable scroll end plate 12*a*.

The third peripheral surface 703 is located between the first peripheral surface 701 and the second peripheral surface 702 in the peripheral surface 73*b*, and connects the first peripheral surface 701 to the second peripheral surface 702. The fourth peripheral surface 704 faces the third peripheral surface 703 in the circumferential direction of the movable scroll end plate 12*a* in the peripheral surface 73*b*, and is located between the first peripheral surface 701 and the second peripheral surface 702. The fourth peripheral surface 704 connects the first peripheral surface 701 to the second peripheral surface 702.

In the peripheral surface 73*b*, the second peripheral surface 702 extends longer in the circumferential direction of the movable scroll end plate 12*a* than the first peripheral surface 701. As the third peripheral surface 703 and the fourth peripheral surface 704 extend from the second peripheral surface 702 to the first peripheral surface 701, the third peripheral surface 703 and the fourth peripheral surface 704 approach each other in the circumferential direction of the movable scroll end plate 12*a*.

The connection surface 73*c* is located between the bottom surface 73*a* and the peripheral surface 73*b*, and connects the bottom surface 73*a* to the peripheral surface 73*b*. The connection surface 73*c* has a first connection portion 711, a second connection portion 712, a third connection portion 713, and a fourth connection portion 714.

Figure 11:
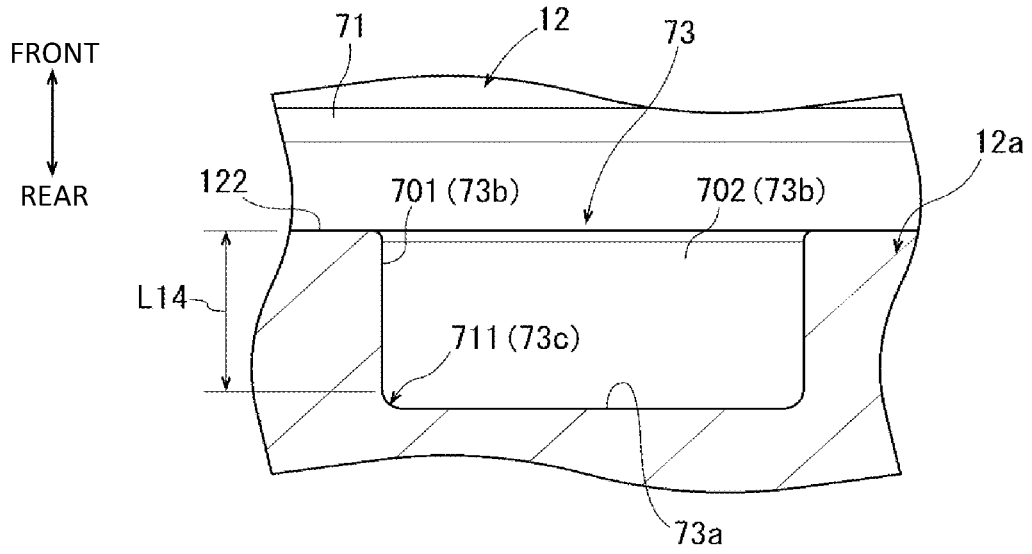
FIG. 11 is a cross-sectional view taken along a line E-E of FIG. 8, illustrating an enlarged main part of the adjustment portion according to the scroll compressor of the second embodiment.
Figure 12:
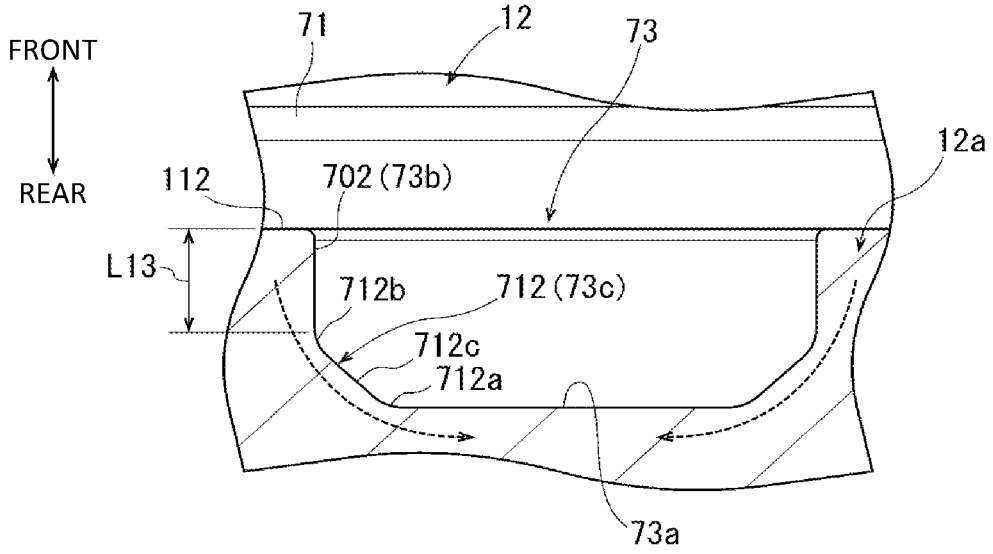
FIG. 12 is a cross-sectional view taken along a line F-F of FIG. 8, illustrating an enlarged main part of the adjustment portion according to the scroll compressor of the second embodiment.

As illustrated in FIGS. 10 and 11, the first connection portion 711 is located between the bottom surface 73*a* and the first peripheral surface 701. As illustrated in FIGS. 10 and 12, the second connection portion 712 is located between the bottom surface 73*a* and the second peripheral surface 702, and connects the bottom surface 73*a* to the second peripheral surface 702. As illustrated in FIG. 8, the third connection portion 713 is located between the bottom surface 73*a* and the third peripheral surface 703. The fourth connection portion 714 is located between the bottom surface 73*a* and the fourth peripheral surface 704. In the connection surface 73*c*, the first connection portion 711 is located closest to the outer periphery of the movable scroll end plate 12*a*, and the second connection portion 712 is located closest to the driving axis O.

As illustrated in FIGS. 10 and 12, the second connection portion 712 has a bottom surface side second connection part 712*a*, a peripheral surface side second connection part 712*b*, and a second flat part 712*c*. The bottom surface side second connection part 712*a* is connected to the bottom surface 73*a*, and extends to be curved toward the second peripheral surface 702. The peripheral surface side second connection part 712*b* is connected to the second peripheral surface 702, and extends to be curved toward the bottom surface 73*a*. The second flat part 712*c* is located between the bottom surface side second connection part 712*a* and the peripheral surface side second connection part 712*b*. The second flat part 712*c* extends in a flat shape, and connects the bottom surface side second connection part 712*a* to the peripheral surface side second connection part 712*b*.

With the bottom surface side second connection part 712*a*, the peripheral surface side second connection part 712*b*, and the second flat part 712*c*, the second connection portion 712 has an overall shape that is upwardly inclined from the bottom surface 73*a* toward the second peripheral surface 702, and connects the bottom surface 73*a* to the second peripheral surface 702. In other word, the second connection portion 712 has a shape in which a portion connecting the bottom surface 73*a* to the second peripheral surface 702 is chamfered, when the second adjustment portion 73 is seen in a cross-section taken along a line D-D of FIG. 8. The cross-section taken along the line D-D also corresponds to the reference cross-section in the present disclosure, and the cross-section is a cross-section of the movable scroll end plate 12*a* extending in the driving axis O direction through the first peripheral surface 701, the second peripheral surface 702, and the driving axis O.

On the other hand, as illustrated in FIGS. 10 and 11, unlike the second connection portion 712, the first connection portion 711 does not have the bottom surface side second connection part 712*a*, the peripheral surface side second connection part 712*b*, and the second flat part 712*c*. Accordingly, as illustrated in FIG. 10, the first connection portion 711 is curved in an arc shape with a predetermined radius of curvature, when seen in the cross-section taken along the line D-D, and connects the bottom surface 73*a* to the first peripheral surface 701.

The third connection portion 713 and the fourth connection portion 714 illustrated in FIG. 8 are symmetrical to each other in the circumferential direction of the movable scroll end plate 12*a*. The third connection portion 713 is curved in an arc shape and connects the bottom surface 73*a* to the third peripheral surface 703, and the fourth connection portion 714 is curved in an arc shape and connects the bottom surface 73*a* to the fourth peripheral surface 704. Furthermore, the third connection portion 713 and the fourth connection portion 714 are located between the first connection portion 711 and the second connection portion 712 in the radial direction of the movable scroll end plate 12*a*. Thus, the third connection portion 713 and the fourth connection portion 714 are each connected to the first connection portion 711 and the second connection portion 712.

As illustrated in FIG. 10, in the cross-section taken along the line D-D, the followings are assumed: a third imaginary line Y3 extending straight from the bottom surface 73*a* toward the driving axis O; a fourth imaginary line Y4 extending straight from the second peripheral surface 702 toward the third imaginary line Y3; and a second imaginary arc R2 equal to an arc of the first connection portion 711. The second imaginary arc R2 is in contact with the third imaginary line Y3 and the fourth imaginary line Y4, and located between the bottom surface 73*a* and the second peripheral surface 702. As a result, the second connection portion 712, more specifically, the bottom surface side second connection part 712*a*, the peripheral surface side second connection part 712*b*, and the second flat part 712*c* face an intersection M2 of the third imaginary line Y3 and the fourth imaginary line Y4 across the second imaginary arc R2.

As compared with a case where the bottom surface 73*a* and the first peripheral surface 701 are connected by the first connection portion 711 in an arc shape, the bottom surface 73*a* and the second peripheral surface 702 are more gently connected by the second connection portion 712. Although not illustrated in detail, the second connection portion 712 is more gently curved than the third connection portion 713 and the fourth connection portion 714.

Thus, the second connection portion 712 more gently connects the bottom surface 73*a* to the second peripheral surface 702 than the first connection portion 711 connects the bottom surface 73*a* to the first peripheral surface 701 in an arc shape, so that the second peripheral surface 702 extends shorter in the driving axis O direction than the first peripheral surface 701. Specifically, while the first peripheral surface 701 extends by a fourth length L14 from the bottom surface 73*a* to the front surface 122, the second peripheral surface 702 extends by a third length L13 shorter than the fourth length L14 from the bottom surface 73*a* to the front surface 122.

As described above, the third peripheral surface 703 connects the first peripheral surface 701 to the second peripheral surface 702. In addition, the third connection portion 713 connects the first connection portion 711 to the second connection portion 712. This means that in the third connection portion 713, a portion close to the second connection portion 712 more gently connects the bottom surface 73*a* to the third peripheral surface 703, as compared with a portion close to the first connection portion 711. With these configurations, the third peripheral surface 703 extends by the third length L13 from the bottom surface 73*a* to the front surface 122 at a connection portion between the third peripheral surface 703 and the second peripheral surface 702, whereas the third peripheral surface 703 extends by the fourth length L14 from the bottom surface 73*a* to the front surface 122 at a connection portion between the third peripheral surface 703 and the first peripheral surface 701. That is, a length of the third peripheral surface 703 in the driving axis O direction is gradually decreased from the fourth length L14 to the third length L13, as the third peripheral surface 703 extends from the first peripheral surface 701 to the second peripheral surface 702. Although not illustrated, a length of the fourth peripheral surface 704 in the driving axis O direction is also gradually decreased from the fourth length L14 to the third length L13, as the fourth peripheral surface 704 extends from the first peripheral surface 701 to the second peripheral surface 702. The third peripheral surface 703, the fourth peripheral surface 704, the third connection portion 713, and the fourth connection portion 714 may be designed in any shape as appropriate.

As illustrated in FIG. 9, the movable scroll spiral element 12*b* is integrally formed with the rear surface 121 of the movable scroll end plate 12*a*. The movable scroll spiral element 12*b* spirally protrudes from the rear surface 121 toward the fixed scroll 9 in the direction in which the rotating axis X extends and the driving axis O direction. The other configurations of the movable scroll spiral element 12*b* are the same as those of the movable scroll spiral element 11*b* in the first embodiment, and the detail description thereof is omitted.

Figure 13:
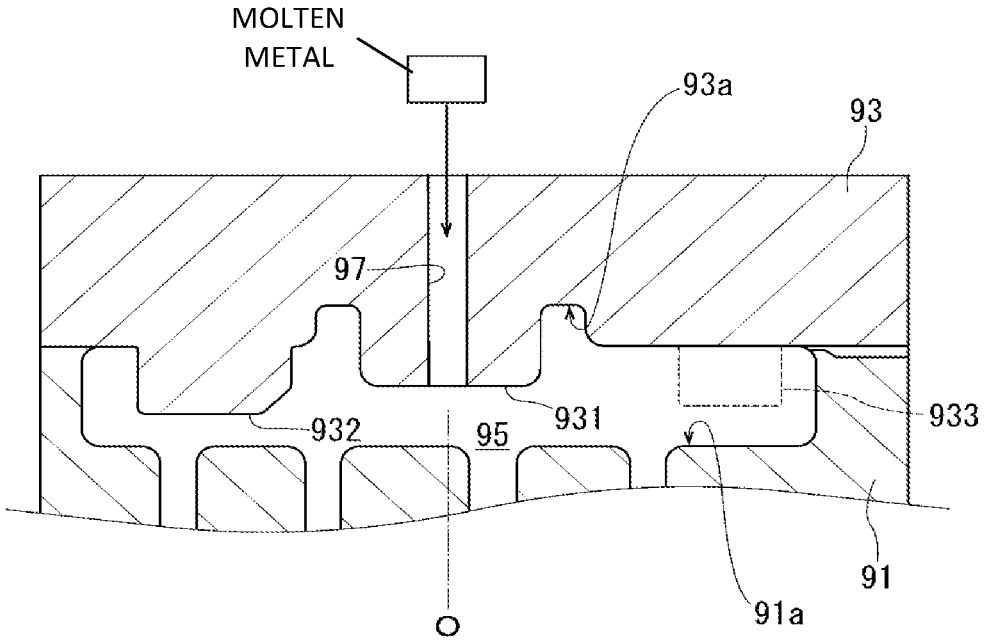
FIG. 13 is a schematic view illustrating a process of producing the second scroll according to the scroll compressor of the second embodiment.

Similarly to the movable scroll 11 in the first embodiment, the movable scroll 12 is also formed by a preparation process, a casting process, and a finishing process. Specifically, in the preparation process, a third casting mold 91 and a fourth casting mold 93 illustrated in FIG. 13 are prepared. The third casting mold 91 has a third forming surface 91*a*, and the fourth casting mold 93 has a fourth forming surface 93*a*. When the third casting mold 91 and the fourth casting mold 93 are clamped while the third forming surface 91*a* and the fourth forming surface 93*a* face each other, a second mold cavity 95 is defined by the third forming surface 91*a* and the fourth forming surface 93*a*.

The fourth forming surface 93*a* has a holding portion forming part 931 used for forming the holding portion 71, a second adjustment portion forming portion 932 used for forming the second adjustment portions 73, and an accommodation portion forming part 933 used for forming the accommodation portions 75.

A second pouring hole 97 is formed in the fourth casting mold 93. The second pouring hole 97 is connected to a portion of the second mold cavity 95 close to the driving axis O, that is, a portion of the movable scroll end plate 12*a* closer to the driving axis O than the outer periphery of the movable scroll end plate 12*a*.

Then, in the casting process, molten metal is supplied from the second pouring hole 97, and poured into the second mold cavity 95. Here, while the molten metal is pressurized as appropriate by a plunger (not illustrated), the molten metal is poured into the second mold cavity 95. The molten metal poured into the second mold cavity 95 is locally pressurized by a squeeze pin (not illustrated).

The second pouring hole 97 is connected to the portion of the second mold cavity 95 close to the driving axis O. Accordingly, the molten metal supplied through second pouring hole 97, in the second mold cavity 95, flows from a portion to form the movable scroll end plate 12*a* close to the driving axis O, that is, the center of the movable scroll end plate 12*a*, toward the outer periphery of the movable scroll end plate 12*a*. Then, in the finishing process, the molten metal is cooled and solidified in the second mold cavity 95 to form a preformed workpiece (not illustrated) of the movable scroll 12. Then, similarly to the movable scroll 11 in the first embodiment, when a finishing treatment is applied on the preformed workpiece, the forming of the movable scroll 12 completes.

Thus, also in the second embodiment, not only the movable scroll spiral element 12*b* but also the holding portion 71, the second adjustment portion 73, and the accommodation portions 75 are integrally formed with the movable scroll end plate 12*a* at the same time by casting the movable scroll 12. That is, in the second adjustment portion 73 formed by the casting, as described above, the second adjustment portion forming portion 932 of the fourth forming surface 93*a* is formed such that the length of the second peripheral surface 702 in the driving axis O direction is shorter than the length of the first peripheral surface 701 in the driving axis O direction, the second connection portion 712 is more gently curved than the first connection portion 711, and the lengths of the third peripheral surface 703 and the fourth peripheral surface 704 in the driving axis O direction are gradually decreased as the third peripheral surface 703 and the fourth peripheral surface 704 extend from first peripheral surface 701 to the second peripheral surface 702. The other configurations of this compressor are the same as those of the compressor in the first embodiment, and the detailed description thereof will be omitted.

In this compressor, in forming the movable scroll 12 by the casting, the molten metal flows from the portion of the second mold cavity 95 to form a portion of the movable scroll end plate 12*a* close to the driving axis O toward the outer periphery of the movable scroll end plate 12*a*. That is, in the peripheral surface 73*b*, the second peripheral surface 702 is located upstream of the first peripheral surface 701 in a flowing direction of the molten metal, and in the connection surface 73*c*, the second connection portion 712 is located upstream of the first connection portion 711 in the flowing direction of the molten metal. Here, the second connection portion 712 faces the intersection M2 of the third imaginary line Y3 and the fourth imaginary line Y4 across the second imaginary arc R2, and connects the bottom surface 73*a* to the second peripheral surface 702 with a gentler curve than that of the first connection portion 711 formed in an arc shape.

While the first peripheral surface 701 extends from the bottom surface 73*a* to the front surface 122 by the fourth length L14, the second peripheral surface 702 extends from the bottom surface 73*a* to the front surface 122 by the third length L13 shorter than the fourth length L14.

In this compressor, these configurations increase fluidity of the molten metal to form the second peripheral surface 702 and the second connection portion 712 when the movable scroll 12 is casted, as indicated in arrows of FIG. 12, which are drawn by a broken line. In other word, the molten metal suitably flows on portions of the second mold cavity 95 to form the second peripheral surface 702 and the second connection portion 712. For this reason, in this compressor, even when the second adjustment portions 73 are deeply recessed, the second adjustment portions 73 each including the second peripheral surface 702 and the second connection portion 712 are suitably formed.

In this compressor, the second connection portion 712 has the bottom surface side second connection part 712*a*, the peripheral surface side second connection part 712*b*, and the second flat part 712*c*. With this configuration, when each of the second adjustment portions 73 is seen in the cross-section taken along the line D-D, the second connection portion 712, which connects the bottom surface 73*a* to the second peripheral surface 702, has the chamfered shape. Due to the second flat part 712*c*, the fluidity of the molten metal to form the second connection portion 712 is sufficiently increased. The other effects of this compressor are the same as those of the compressor in the first embodiment.

Third Embodiment

Figure 14:
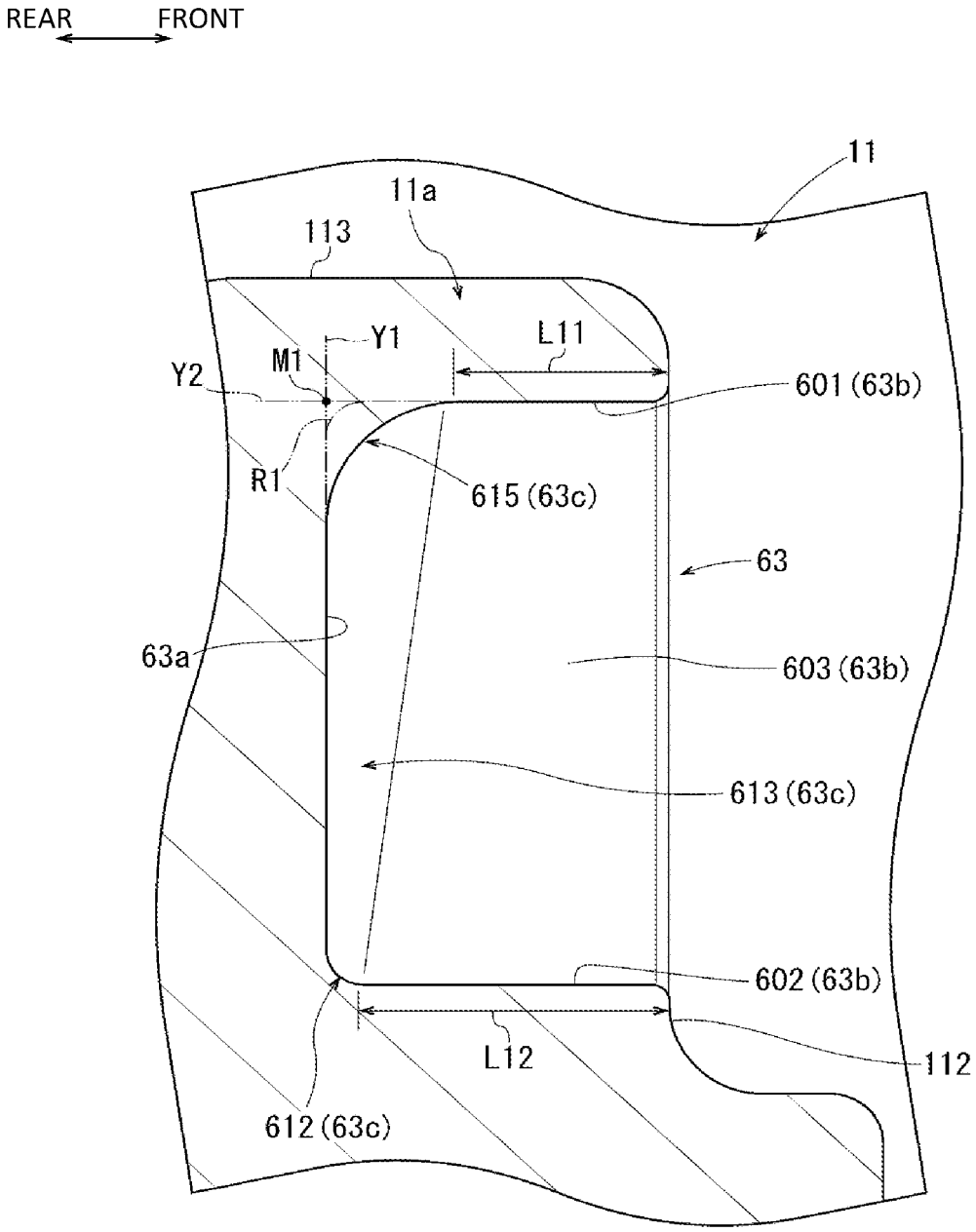
FIG. 14 is a cross-sectional view illustrating an enlarged main part of an adjustment portion according to a scroll compressor of a third embodiment, similarly to FIG. 4.

As illustrated in FIG. 14, in the compressor according to the third embodiment, the connection surface 63*c* has a first connection portion 615, instead of the first connection portion 611. That is, in this compressor, the connection surface 63*c* has the first connection portion 615, the second connection portion 612, the third connection portion 613, and the fourth connection portion 614. Thus, the third connection portion 613 and the fourth connection portion 614 are each connected to the first connection portion 615 and the second connection portion 612.

The first connection portion 615, when seen in the cross-section taken along the line A-A, is curved in an arc shape with a radius of curvature larger than that of the second connection portion 612, and connects the bottom surface 63*a* to the first peripheral surface 601. Accordingly, the first connection portion 615 faces the intersection M1 of the first imaginary line Y1 and the second imaginary line Y2 across the first imaginary arc R1. The first connection portion 615 is more gently curved than the second connection portion 612. The other configurations of this compressor are the same as those of the compressor in the first embodiment.

As described above, since the first connection portion 615 is more gently curved than the second connection portion 612, also in this compressor in the third embodiment, similarly to the compressor in the first embodiment, while the second peripheral surface 602 extends from the bottom surface 63*a* to the front surface 112 by the second length L12, the first peripheral surface 601 extends from the bottom surface 63*a* to the front surface 112 by the first length L11 shorter than the second length L12. In addition, in the third connection portion 613, a portion close to the first connection portion 615 more gently connects the bottom surface 63*a* to the third peripheral surface 603, as compared with a portion close to the second connection portion 612. Similarly, also in the fourth connection portion 614, a portion close to the first connection portion 615 more gently connects the bottom surface 63*a* to the fourth peripheral surface 604, as compared with a portion close to the second connection portion 612. That is, lengths of the third peripheral surface 603 and the fourth peripheral surface 604 are gradually decreased from the second length L12 to the first length L11, as the third peripheral surface 603 and the fourth peripheral surface 604 extend from the second peripheral surface 602 to the first peripheral surface 601.

As a result, also in this compressor, in forming the movable scroll 11 by the casting, when molten metal flows from the portion of the first mold cavity 85 to form the outer peripheral portion of the movable scroll end plate 11*a* toward the driving axis O, fluidity of the molten metal to form the first peripheral surface 601 and the first connection portion 615 is increased. The other effects of this compressor are the same as those of the compressor in the first embodiment.

Fourth Embodiment

Figure 15:
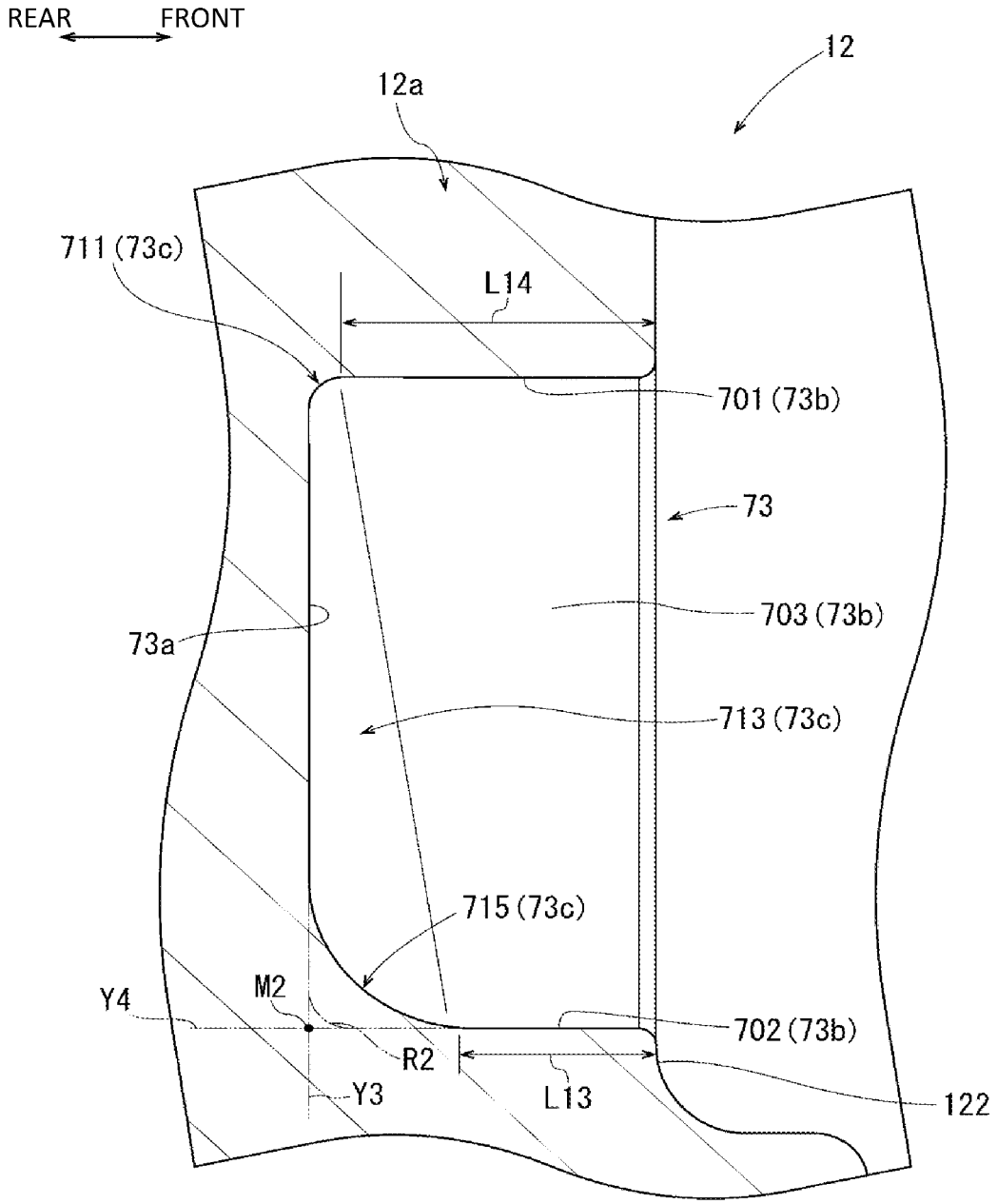
FIG. 15 is a cross-sectional view illustrating an enlarged main part of an adjustment portion according to a scroll compressor of a fourth embodiment, similarly to FIG. 10.

As illustrated in FIG. 15, in the compressor according to the fourth embodiment, the connection surface 73*c* has a second connection portion 715, instead of the second connection portion 712. That is, in this compressor, the connection surface 73*c* has the first connection portion 711, the second connection portion 715, the third connection portion 713, and the fourth connection portion 714. Thus, the third connection portion 713 and the fourth connection portion 714 are each connected to the first connection portion 711 and the second connection portion 715.

The second connection portion 715, when seen in the cross-section taken along the line D-D, is curved in an arc shape with a radius of curvature larger than that of the first connection portion 711, and connects the bottom surface 73*a* to the second peripheral surface 702. Accordingly, the second connection portion 715 faces the intersection M2 of the third imaginary line Y3 and the fourth imaginary line Y4 across the second imaginary arc R2. The second connection portion 715 is more gently curved than the first connection portion 711. The other configurations of this compressor are the same as those of the compressor in the second embodiment.

As described above, since the second connection portion 715 is more gently curved than the first connection portion 711, also in this compressor in the fourth embodiment, similarly to the compressor in the second embodiment, while the first peripheral surface 701 extends from the bottom surface 73*a* to the front surface 122 by the fourth length L14, the second peripheral surface 702 extends from the bottom surface 73*a* to the front surface 122 by the third length L13 shorter than the fourth length L14. In addition, in the third connection portion 713, a portion close to the second connection portion 715 more gently connects the bottom surface 73*a* to the third peripheral surface 703, as compared with a portion close to the first connection portion 711. Similarly, also in the fourth connection portion 714, a portion close to the second connection portion 715 more gently connects the bottom surface 73*a* to the fourth peripheral surface 704, as compared with a portion close to the first connection portion 711. That is, lengths of the third peripheral surface 703 and the fourth peripheral surface 704 are gradually decreased from the fourth length L14 to the third length L13, as the third peripheral surface 703 and the fourth peripheral surface 704 extend from the first peripheral surface 701 to the second peripheral surface 702.

As a result, also in this compressor, in forming the movable scroll 12 by the casting, when molten metal flows from the portion of the second mold cavity 95 to form the movable scroll end plate 11*a* close to the driving axis O toward the outer periphery of the movable scroll end plate 12*a*, fluidity of the molten metal to form the second peripheral surface 702 and the second connection portion 715 is increased. The other effects of this compressor are the same as those of the compressor in the first embodiment.

The present disclosure is not limited to the above-described first embodiment to fourth embodiment, and may be modified as appropriate within the gist of the disclosure.

For example, in the compressor in each of the first embodiment to the fourth embodiment, the fixed scroll 9 corresponds to the "first scroll" in the present disclosure. However, the present disclosure is not limited to this aspect, and the present disclosure may have a configuration in which the movable scrolls 11, 12 rotate about the driving axis O relative to the first scroll rotating about the rotating axis X.

In the compressor of each of the first embodiment and the third embodiment, the first connection portions 611, 615 and the second connection portion 612 may be designed in any shape as appropriate, as long as the length of the first peripheral surface 601 in the driving axis O direction is shorter than the length of the second peripheral surface 602 in the driving axis O direction. Similarly, in the compressor of each of the second embodiment and the fourth embodiment, as long as the length of the second peripheral surface 702 in the driving axis O direction is shorter than the length of the first peripheral surface 701 in the driving axis O direction, the first connection portion 711 and the second connection portions 712, 715 may be designed in any shape as appropriate.

In the compressor of each of the first embodiment and the third embodiment, the lengths of the third peripheral surface 603 and the fourth peripheral surface 604 in the driving axis O direction may be decreased step by step, as the third peripheral surface 603 and the fourth peripheral surface 604 extend from the second peripheral surface 602 to the first peripheral surface 601. Similarly, in the compressor of each of the second embodiment and the fourth embodiment, the lengths of the third peripheral surface 703 and the fourth peripheral surface 704 in the driving axis O direction may be decreased step by step, as the third peripheral surface 703 and the fourth peripheral surface 704 extend from the first peripheral surface 701 to the second peripheral surface 702.

In the compressor of each of the first embodiment to the fourth embodiment, the plurality of rings 47 and the plurality of anti-rotation pins 31 constitute the anti-rotation mechanism 16. However, the present disclosure is not limited to this aspect, and the anti-rotation mechanism 16 may be configured in other ways.

In the compressor of each of the first embodiment to the fourth embodiment, the refrigerant gas as the fluid is compressed in the compression chamber 49. However, the present disclosure is not limited to this aspect, fluid such as air supplied to a fuel cell may be compressed in the compression chamber 49.

INDUSTRIAL APPLICABILITY

The present disclosure is usable for an air conditioner in a vehicle, or the like.

What is claimed is:

1. A scroll compressor comprising:

a housing;

a first scroll disposed in the housing; and a second scroll disposed in the housing and facing the first scroll to form a compression chamber between the first scroll and the second scroll, the second scroll being configured to rotate relative to the first scroll about a driving axis of the scroll compressor to compress fluid in the compression chamber, the second scroll having:

an end plate formed in a disc shape extending orthogonally to the driving axis, the end plate having a first surface facing the first scroll and a second surface located opposite to the first surface;

a spiral element integrally formed with the end plate and spirally protruding from the first surface toward the first scroll in a direction in which the driving axis extends; and an adjustment portion formed in the end plate and recessed from the second surface toward the first surface, the adjustment portion adjusting a center-of-gravity of the second scroll, wherein the adjustment portion has:

a bottom surface extending in parallel with the second surface;

a peripheral surface enclosing the bottom surface and extending in the direction in which the driving axis extends; and a connection surface located between the bottom surface and the peripheral surface, and connecting the bottom surface to the peripheral surface, the peripheral surface has a first peripheral surface located close to an outer periphery of the end plate and a second peripheral surface located closer to the driving axis than the first peripheral surface and facing the first peripheral surface in a radial direction of the end plate, and a length of the first peripheral surface in the direction in which the driving axis extends is shorter than a length of the second peripheral surface in the direction in which the driving axis extends.

2. The scroll compressor according to claim 1, wherein the connection surface has a first connection portion connecting the bottom surface to the first peripheral surface, and the first connection portion has:

a bottom surface side first connection part connected to the bottom surface and extending to be curved toward the first peripheral surface;

a peripheral surface side first connection part connected to the first peripheral surface and extending to be curved toward the bottom surface; and a first flat part located between the bottom surface side first connection part and the peripheral surface side first connection part, extending in a flat shape, and connecting the bottom surface side first connection part to the peripheral surface side first connection part.

3. The scroll compressor according to claim 1, wherein a cross-section of the end plate extending in the direction in which the driving axis extends through the first peripheral surface, the second peripheral surface, and the driving axis is defined as a reference cross-section, the connection surface has a first connection portion connecting the bottom surface to the first peripheral surface, and the first connection portion is formed in an arc shape when seen in the reference cross-section.

4. The scroll compressor according to claim 1, wherein the peripheral surface has a third peripheral surface connecting the first peripheral surface to the second peripheral surface, and a length of the third peripheral surface in the direction in which the driving axis extends is gradually decreased as the third peripheral surface extends from the second peripheral surface to the first peripheral surface.

5. A scroll compressor, comprising:

a housing;

a first scroll disposed in the housing; and a second scroll disposed in the housing and facing the first scroll to form a compression chamber between the first scroll and the second scroll, the second scroll being configured to rotate relative to the first scroll about a driving axis of the scroll compressor to compress fluid in the compression chamber, the second scroll having:

an end plate formed in a disc shape extending orthogonally to the driving axis, the end plate having a first surface facing the first scroll and a second surface located opposite to the first surface;

a spiral element integrally formed with the end plate and spirally protruding from the first surface toward the first scroll in a direction in which the driving axis extends; and an adjustment portion formed in the end plate and recessed from the second surface toward the first surface, the adjustment portion adjusting a center-of-gravity of the second scroll, wherein the adjustment portion has:

a bottom surface extending in parallel with the second surface;

a peripheral surface enclosing the bottom surface and extending in the direction in which the driving axis extends; and a connection surface located between the bottom surface and the peripheral surface, and connecting the bottom surface to the peripheral surface, the peripheral surface has a first peripheral surface located close to an outer periphery of the end plate and a second peripheral surface located closer to the driving axis than the first peripheral surface and facing the first peripheral surface in a radial direction of the end plate, and a length of the second peripheral surface in the direction in which the driving axis extends is shorter than a length of the first peripheral surface in the direction in which the driving axis extends.

6. The scroll compressor according to claim 5, wherein the connection surface has a second connection portion connecting the bottom surface to the second peripheral surface, and the second connection portion has:

a bottom surface side second connection part connected to the bottom surface, and extending to be curved toward the second peripheral surface;

a peripheral surface side second connection part connected to the second peripheral surface, and extending to be curved toward the bottom surface; and a second flat part located between the bottom surface side second connection part and the peripheral surface side second connection part, extending in a flat shape, and connecting the bottom surface side second connection part to the peripheral surface side second connection portion.

7. The scroll compressor according to claim 5, wherein a cross-section of the end plate extending in the direction in which the driving axis extends through the first peripheral surface, the second peripheral surface, and the driving axis is defined as a reference cross-section, the connection surface has a second connection portion connecting the bottom surface to the second peripheral surface, and the second connection portion is formed in an arc shape when seen in the reference cross-section.

8. The scroll compressor according to claim 5, wherein the peripheral surface has a third peripheral surface connecting the first peripheral surface to the second peripheral surface, and a length of the third peripheral surface in the direction in which the driving axis extends is gradually decreased as the third peripheral surface extends from the first peripheral surface to the second peripheral surface.

* * * * *